US009566579B1

(12) United States Patent
Kozlenko

(10) Patent No.: US 9,566,579 B1
(45) Date of Patent: Feb. 14, 2017

(54) LOW INSERTION FORCE, LOW WOBBLE SEROLOGICAL PIPETTE

(71) Applicant: VistaLab Technologies, Inc., Brewster, NY (US)

(72) Inventor: Yevgeniy Kozlenko, New Fairfield, CT (US)

(73) Assignee: Vistalab Technologies, Inc., Brewster, NY (US)

( * ) Notice: Subject to any disclaimer, the term of this patent is extended or adjusted under 35 U.S.C. 154(b) by 0 days.

(21) Appl. No.: 15/147,728

(22) Filed: May 5, 2016

Related U.S. Application Data

(60) Provisional application No. 62/214,005, filed on Sep. 3, 2015.

(51) Int. Cl.
*B01L 3/02* (2006.01)
*B01L 9/00* (2006.01)
*B01L 99/00* (2010.01)

(52) U.S. Cl.
CPC ..... *B01L 3/021* (2013.01); *B01L 3/0279* (2013.01); *B01L 3/0286* (2013.01); *B01L 9/54* (2013.01); *B01L 2200/0689* (2013.01); *B01L 2200/085* (2013.01); *B01L 2200/087* (2013.01); *B01L 2300/0832* (2013.01); *B01L 2300/123* (2013.01)

(58) Field of Classification Search
CPC ..... B01L 3/021
USPC ..... 422/501
See application file for complete search history.

(56) References Cited

U.S. PATENT DOCUMENTS

| | | | | |
|---|---|---|---|---|
| 5,563,356 | A | 10/1996 | Mussi et al. | |
| 2004/0022688 | A1 | 2/2004 | Blackwood | |
| 2005/0089450 | A1* | 4/2005 | Al-Mahareeq | B01L 3/0279 422/400 |
| 2010/0218622 | A1* | 9/2010 | Motadel | B01L 3/0279 73/864.01 |
| 2011/0214517 | A1 | 9/2011 | Butz et al. | |
| 2012/0096957 | A1* | 4/2012 | Ochman | B01L 3/021 73/864.01 |

OTHER PUBLICATIONS

International Search Report issued Oct. 4, 2016 in International Patent Application No. PCT/US2016/049922.
Written Opinion issued Oct. 4, 2016 in International Patent Application No. PCT/US2016/049922.

* cited by examiner

*Primary Examiner* — Neil N Turk
(74) *Attorney, Agent, or Firm* — Venable LLP; Steven J. Schwarz; Kerri M. Patterson

(57) ABSTRACT

A serological pipet for use with liquid handling may include a tip and a mounting portion with at least two sections with substantially circular cross-sections configured to fit into a pipet controller holder, the mounting portion may include a porous filter. The pipet may also include a tubular shaft with permanently marked volume indicating graduation marks. The tubular shaft may connect the tip and the mounting portion. A first section of the at least two sections and a second section of the at least two sections may have different diameters and a distance between the first section and the second section may be dimensioned to inscribe a cone having an angle of 11 degrees plus or minus 5 degrees. The tip, the mounting portion, and the tubular shaft may be made out of plastic resin.

23 Claims, 25 Drawing Sheets

SECTION A-A

SECTION C-C

SECTION D-D

SECTION A-A

DETAIL B
SCALE 2 : 1

LOW INSERTION FORCE, LOW WOBBLE SEROLOGICAL PIPETTE

CROSS-REFERENCE TO RELATED APPLICATIONS

This application claims priority to U.S. Provisional Application No. 62/214,005, filed Sep. 3, 2015, which is hereby incorporated herein by reference in its entirety.

BACKGROUND

Field of Invention

The invention relates to liquid handling and in particular, to a low insertion force and low wobble pipet.

BRIEF DESCRIPTION OF THE DRAWINGS

The foregoing and other features and advantages of the invention will be apparent from the following, more particular description of various exemplary embodiments, as illustrated in the accompanying drawings wherein like reference numbers generally indicate identical, functionally similar, and/or structurally similar elements. The first digits in the reference number indicate the drawing in which an element first appears.

FIGS. 15A-5C depict a 5 ml low wobble pipet in an embodiment of the invention;

DESCRIPTION OF THE EMBODIMENTS

Figure 1:
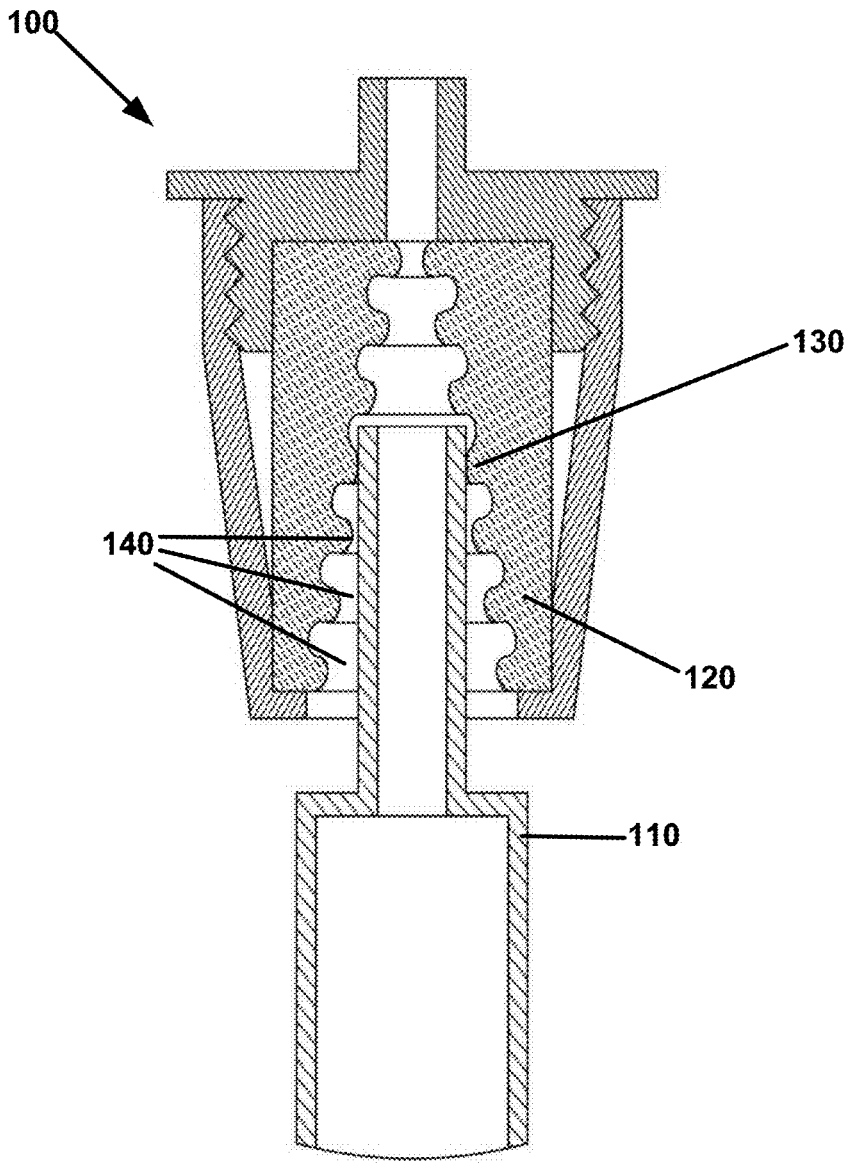
FIG. 1 depicts an example pipet and pipet holder.

Some embodiments of the invention are discussed in detail below. In describing embodiments, specific terminology is employed for the sake of clarity. However, the invention is not intended to be limited to the specific terminology so selected. A person skilled in the relevant art will recognize that other equivalent components can be employed and other methods developed without departing from the broad concepts of the invention.

All publications cited herein are hereby incorporated by reference in their entirety.

As used herein, the term "a" refers to one or more. The terms "including," "for example," "such as," "e.g.," "may be" and the like, are meant to include, but not be limited to, the listed examples.

Serological pipets are widely used in liquid handling applications in laboratories performing, for example, drug development, environmental testing and diagnostic testing. These pipets may be described as glass or plastic straws of various diameters and lengths (e.g., 14 inches long). The pipets often have graduations printed on them that may range in capacities, for example, from 1 ml to 100 ml. Traditionally, suction is applied to the top end by mouth or a rubber bulb and liquid is drawn into the pipet. Liquid is measured by aspirating to a graduation line, and then dispensed by removing the suction. Pipets are typically discarded after each use in order to avoid cross-contamination. Current practice often employs a pipet controller, which may use small battery powered air pumps and trigger-style pneumatic valves to manipulate pressure inside of serological pipets in order to draw up and expel liquid. Commercially available pipet controllers may include, for example, BrandTech® Accu-jet® Pro, Drummond XP2, Integra Pipet-Boy2, Drummond Pipet-Aid®, Heathrow Scientific® RF3000®, and Sartorius Biohit XL.

Commercially available, disposable serological pipets are generally made to conform to the specifications in ASTM Designation E 934-94 (Reapproved 2015). This specification describes, among other parameters, the allowable outside dimensions for Serological Pipets with volume capacities from 0.5 ml to 50 ml. According to this specification, the outside diameter of the top end of a serological pipet can vary from 0.177 to 0.35 inches (4.5 to 9 mm). In order to provide an air-tight seal on this range of diameters, commercially available pipet controllers typically employ a ribbed, tapered elastic cone into which the serological pipet is inserted. The smaller diameter pipets will seal at the narrow end of the cone and the larger pipets will seal towards the larger diameter opposite end. The cone stretches slightly when a pipet is inserted to ideally form an airtight seal and mechanically hold the pipet.

There are a number of problems with the current state of the art. For example, in order to assure a good seal, users are required to use a substantial amount of force when inserting a pipet into the pipet controller, particularly for the larger size pipets. Due to the nature of the work done with pipets, many users will insert pipets dozens or more times per day. This repetitive work increases the potential for repetitive strain injuries which are common in laboratory workers. Another problem is that the serological pipet is not held firmly in the pipet controller and can wobble when the pipet controller is moved. This is a problem because users often will dispense aliquots from the Serological Pipet into many small wells or receptacles. Any wobble of the pipet makes is harder to align the pipet with the well. Worse yet, the wobble may break the seal momentarily when the pipet controller is moved. A break in the seal may result in a drop or drops of fluid being dispensed from the pipet that may land in the wrong well and ruin an experiment or test. Both the sealing problem and the wobble problem cause users to push the Serological Pipet into the pipet controller with ever-harder force in an attempt to stabilize the pipet. This exacerbates the potential repetitive stress injury and furthermore wears the conical seal more quickly.

It is therefore an object of this invention to substantially reduce the force required to insert and seal a serological pipet into the commonly available pipet controllers, and furthermore to reduce the wobble or angular deflection of the serological pipet in a pipet controller.

FIG. 1 depicts an example of a pipet holder portion of a pipet controller. Pipet holder 100 includes a ribbed, tapered, elastic socket or cone 120 that may expand slightly when serological pipet 110 is inserted. The tapered elastic cone 120 enables the pipet holder to seal on pipets of varying diameters. Elastic cone 120 may have a series of ribs, such as rib 130, designed to hold pipet 110 in place. Elastic cone 120 and, in particular, single rib 130 may form an airtight seal with pipet 110 and mechanically hold pipet 110 in place. As shown in FIG. 1, rib 130 may provide a single point to hold pipet 110 in place, and pipet 110 is not in contact with other ribs of elastic cone 120 as shown by air gaps 140. When discarding pipet 110, the operator has to manually grab pipet 110 and apply physical pressure to remove pipet 110 from elastic cone 120.

Pipet controller holding portion 100 suffers from several problems when retaining and sealing serological pipet 110. For example, to ensure a good seal and a stiff mechanical hold on a serological pipet, the operator has to apply a significant amount of force to insert pipet 110 into elastic cone 120. Since the lever arm formed by the ring of contact by pipet 110 with a single rib (e.g., rib 130) of elastic cone 120 is very small, the mechanical stiffness of such a connection is very low, which leads to a wobbly tip of pipet 110. For example, given that pipets are typically long (e.g., 14 inches), if pipet 110's tip is unsteady, precise pipetting may be very difficult or impossible for an operator to perform.

Figure 2:
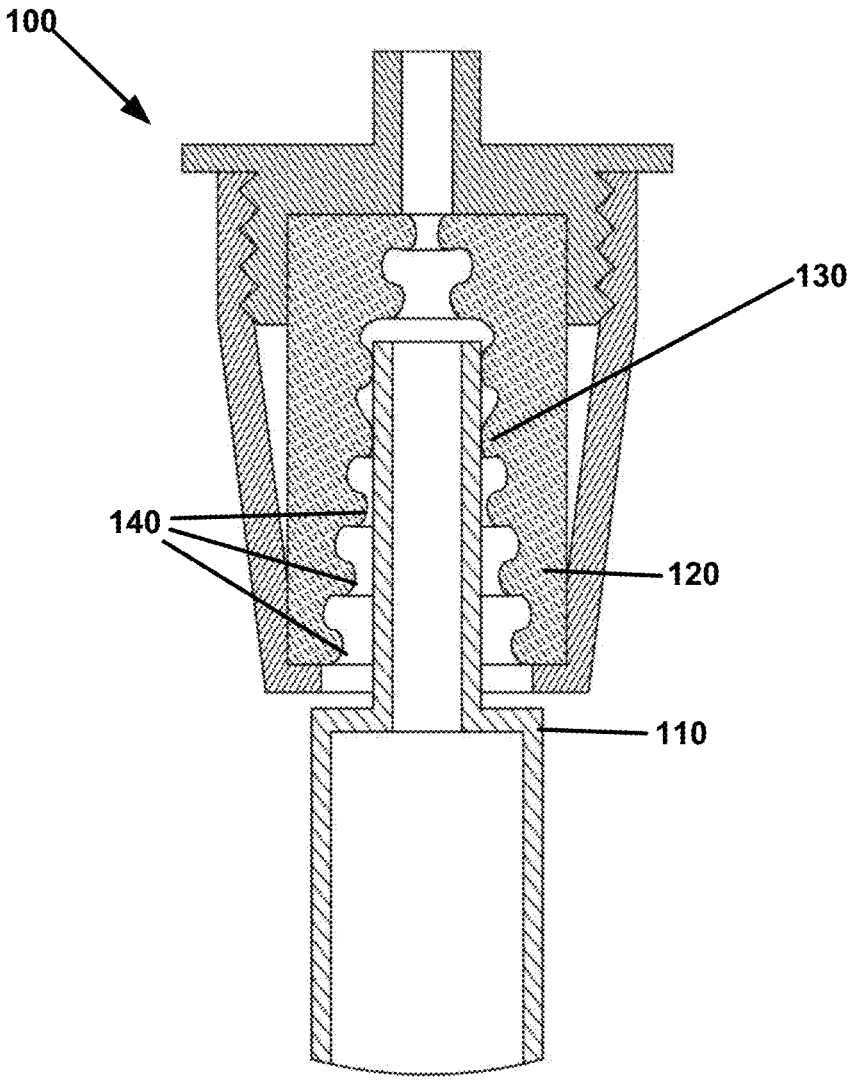
FIG. 2 depicts an example pipet and pipet holder with the pipet being inserted into the pipet holder with high insertion force.

FIG. 2 illustrates a standard technique to attempt to minimize the wobbly pipet tip problem by forcing pipet 110 deeper into elastic cone 120 in order to engage more of the rib features and increase the lever arm. Since the inner diameters of the ribs are progressively smaller, progressively more and more force is required to insert pipet 110 further into elastic cone 120. Accordingly, an excessive amount of force (e.g., greater than 10 lbs.) may be required to provide a more stable pipet. To extract pipet 110 from elastic cone 120, a corresponding significant amount of force by the pipet operator is again required. These high forces can lead to repetitive stress injuries (e.g., carpal tunnel) for lab technicians or other pipet operators. Further, most serological pipets 110 are made out of brittle material (e.g., polystyrene, glass, etc.) and may break when an operator attempts to force them into or extract them from elastic cone 120. Such breakage could be dangerous to the pipet operator due to lacerations from the broken pipet, caustic or contagious agents in the pipet, or both. Additionally, elastic cone 120 experiences a lot of wear due to the high deflection and abrasion forces that they undergo during use and are costly to be replaced regularly. Accordingly, what is needed is a low insertion force, low wobble pipet.

Figure 3:
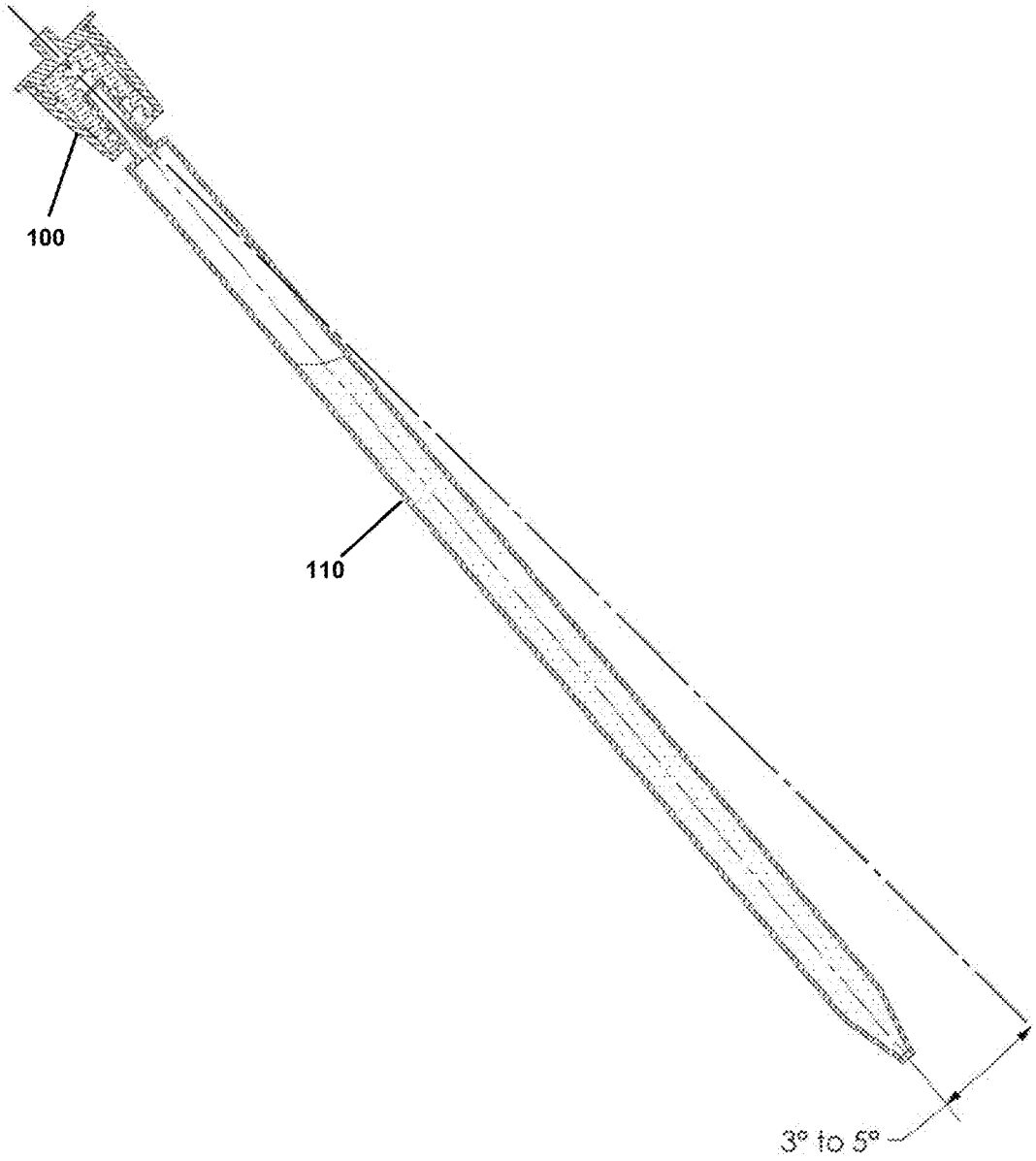
FIG. 3 depicts typical angular deflection of existing pipet designs.

FIG. 3 depicts a typical amount of angular deflection that occurs with existing designs. Standard serological pipets 110 when mounted in a standard pipet controller 400 with holder 100 have low torsional stiffness, which means that the pipet is likely to sag and swing (e.g., wobble) during use. FIG. 3 shows a typical angular deflection ranging at least between 3° to 5° for existing pipet designs. An angular deflection of 3° or more may be too unstable for high precision pipetting. Angular deflection may result in pipet wobble. Pipet wobble may lead to the problems described above such as a lack of precise pipet control and one or more drops of fluid dispensed inadvertently from the pipet.

Figure 4:
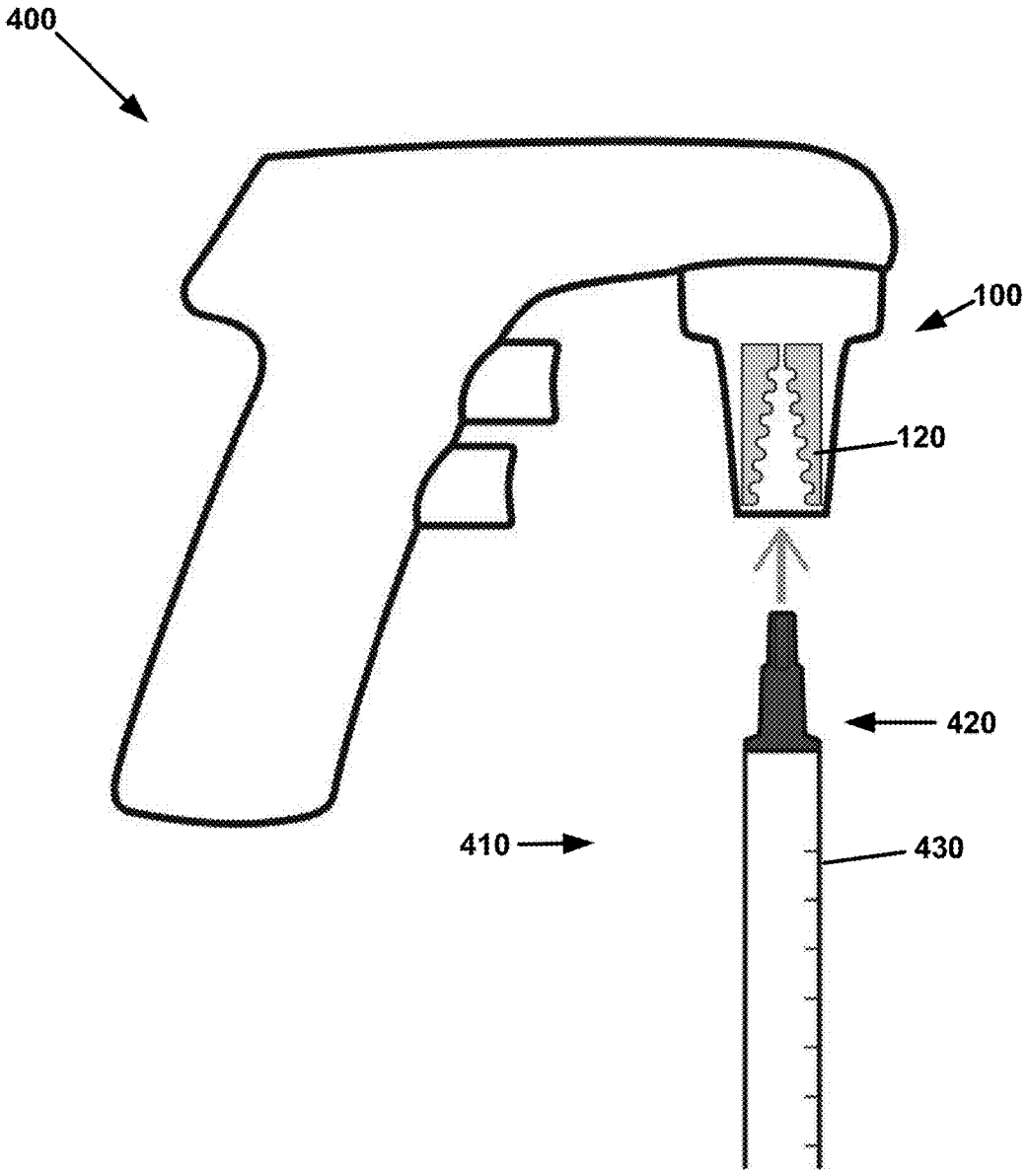
FIG. 4 depicts an example pipet controller and a low insertion force and low wobble pipet in an embodiment of the invention.

FIG. 4 depicts an example pipet controller 400 and an example low insertion force and low wobble pipet 410 in an embodiment of the invention. The mounting portion 420 of the low wobble pipet 410 may be inserted into a standard pipet holder 100 of pipet controller 400, with lower insertion force than a standard pipet 110 and have less wobble. Low wobble pipet 410 may include, for example, a mounting portion 420, a tubular shaft 430, and a conical tip (see FIG. 9, tip 910). Low wobble pipet 410 may be a graduated serological pipet for handling liquids with specially designed mounting portion 420. Shaft 430 may have permanent volume indicating graduation marks on the tubular shaft. Mounting portion 420 is configured to attach pipet 410 to pipet holder 100 in controller 400. Pipet holder 100 may include a ribbed, tapered, elastic socket 120, for example. Mounting portion 420 may simultaneously engage the elastic socket 120 at two or more ribbed locations when inserted into the elastic socket 120.

In one embodiment, pipet 410 may be configured with mounting portion 420 including two or more stepped, tubular sections designed to simultaneously engage two or more elastic sealing ribs within the elastic cones 120 that are the industry standard sockets on most pipet controllers. By simultaneously engaging the socket at two or more locations, a large lever arm may be formed, thus creating a stiffer connection that is more capable of resisting cantilever forces that would otherwise present to the user as a wobbly pipet, particularly at the tip end (see FIG. 9, tip 910). This stiffer connection may be achieved with lower insertion forces than is typical for traditional pipets (e.g., pipet 110).

Figure 5:
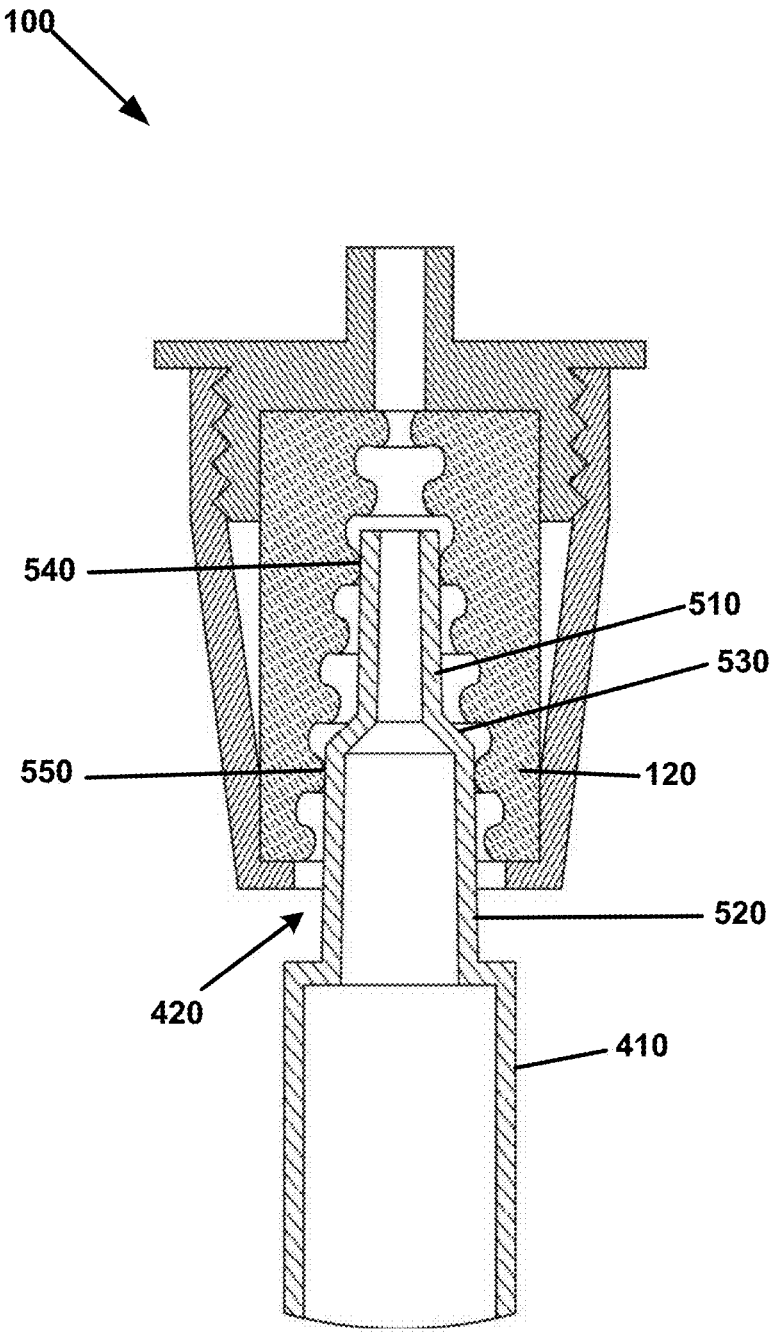
FIG. 5 depicts an example pipet holder with a low insertion force and low wobble pipet inserted into the pipet holder in an embodiment of the invention.

FIG. 5 depicts low wobble pipet 410 that is designed to provide low insertion force (e.g., less than 3 lbs. of force) and low wobble in an embodiment of the invention. In FIG. 5, pipet holder 100 includes a standard ribbed, tapered, elastic cone 120 that may expand slightly to accept a pipet, for example. Elastic cone 120 may include the industry standard sockets for most pipet controllers. Mounting portion 420 may include two or more stepped, tubular sections or substantially cylindrical surfaces with varying diameters. Section 510 (e.g., upper section) and section 520 (e.g., lower section) depict example steps in mounting portion 420. In this example, step 510 has a smaller diameter than step 520.

Riser 530 separates step 510 and step 520. Step 510 and step 520 of mounting portion 420 are designed to simultaneously engage two or more of the elastic sealing ribs within elastic cone 120. For example, in FIG. 5, rib 540 engages step 510 and rib 550 engages step 520. By simultaneously engaging the socket at two or more locations, a larger effective lever arm may be formed, thus creating a stiffer connection that may be more capable of resisting cantilever forces that would otherwise present to the pipet user as an unsteady or wobbly tip of pipet 410. This stiffer connection may be achieved with lower insertion forces than is typical for traditional pipets as pipet 410 may connect to sealing ribs 540 and 550 with a low entry insertion force while maintaining an airtight seal between pipet 410 and elastic cone 120.

Pipet 410 may provide a low force, low wobble pipet that may work with a wide range of pipet controllers available on the market. Pipet 410 may simultaneously engage multiple ribs in a pipet holder's 100 conical, elastic socket (e.g., elastic cone 120). Relatively little force (e.g., less than 3.0 Lb-force which is less force than typical pipets) is needed to engage the elastic ribs of elastic cone 120 with an inner diameter that is slightly smaller than the outer diameter of the top of the pipet, for example. The stepped, tubular top features of pipet 410 may engage two or more of the ribs (e.g., sealing ribs 540 and 550) of elastic cone 120 at the same time, forming a significantly larger lever arm with significantly less force than that needed for the secure insertion of a traditional pipet 110. This larger lever arm means that pipet 410 exhibits very little wobble, such that there is very little angular deflection of pipet 410 when side loaded.

Figure 6:
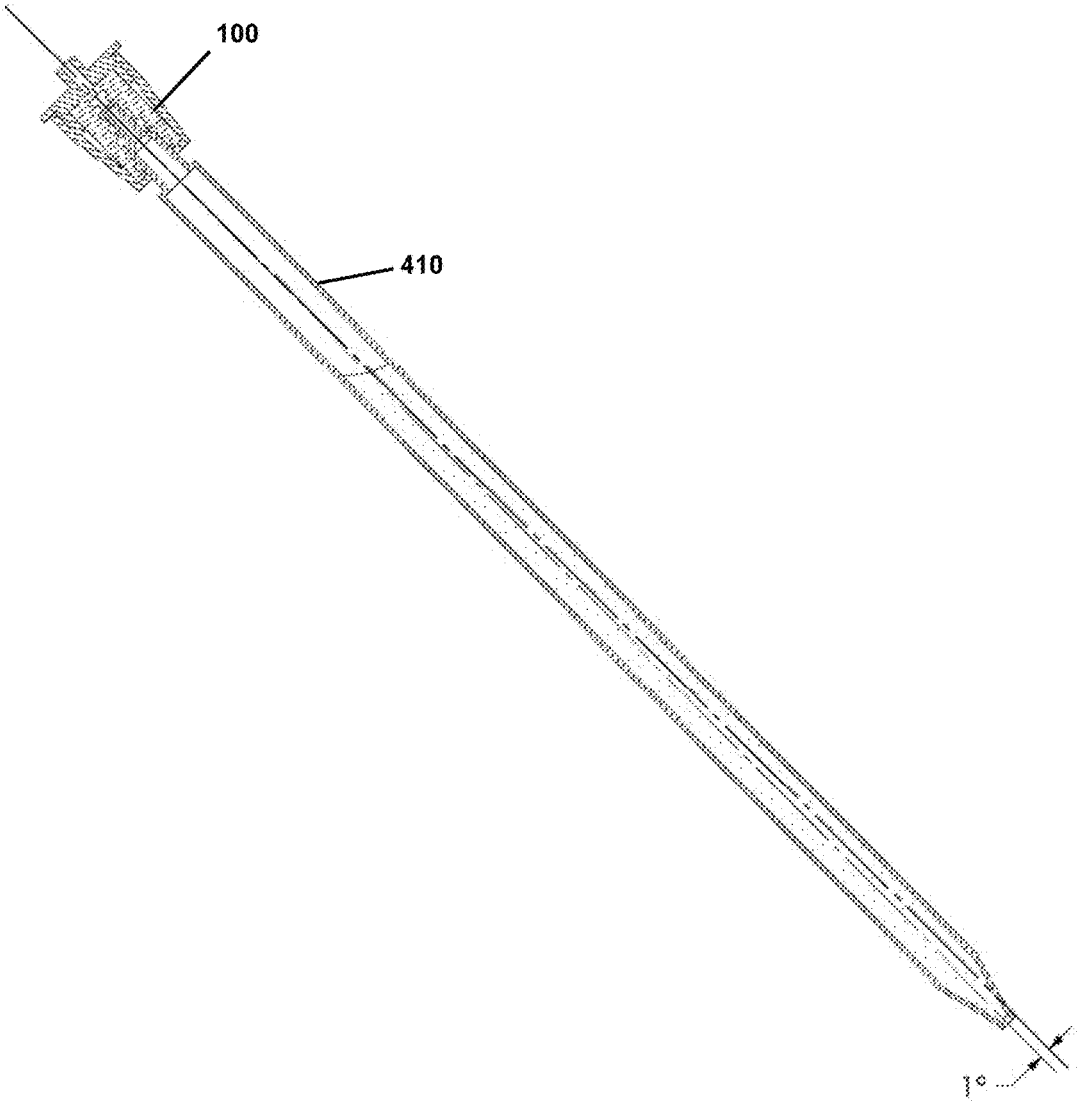
FIG. 6 depicts reduced angular deflection enabled in an embodiment of the invention.

FIG. 6 depicts reduced angular deflection enabled by an embodiment of the invention. Low wobble pipet 410 has a higher torsional stiffness, which means less movement (e.g., less wobble) and more pipetting control. In the embodiment depicted in FIG. 6, a maximum angular deflection of 1° may be achieved. This provides an operator of pipet 410 with a significant amount of improvement in control compared to a typical pipet and allows for high precision pipetting. The reduction in angular deflection also reduces inadvertent leakage from the pipet 410. Since it takes less force to insert pipet 410, less force is needed to remove pipet 410 from the socket of elastic cone 120. This reduction in the typical insertion and withdrawal forces greatly reduces the risk of fracturing pipet 410, alleviates repetitive stress injuries, and reduces the wear on elastic cone 120 in pipet holder 100.

Figure 7:
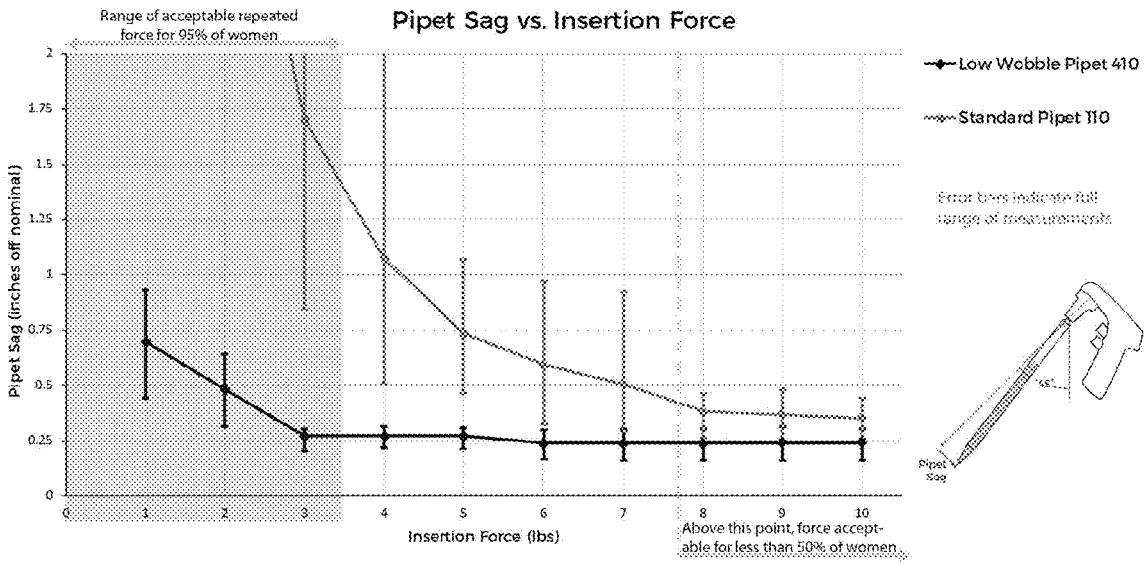
FIG. 7 charts the amount of sag from a nominal pipetting angle measured at each Lb-force of insertion into commercially available pipet controllers.

FIG. 7 charts the amount of sag from a nominal pipetting angle measured at each Lb-force of insertion into a typical pipet controller. In FIG. 7, the amount of sag or wobble from a nominal pipetting angle was measured using 6 commercially available controllers 400 at each lb-force of insertion into pipet holder 100 using a standard pipet 110 and a low wobble pipet 410. As shown in the testing, using low wobble pipet 410, minimal wobble was achieved with a pipet insertion force of 3.0 Lb-force (well within the range of acceptable repeated force for 95% of women). At 3.0 Lb-force, standard pipet 110 has more than five times the sag or wobble on average. Additionally, standard pipet 110 may not even reach the minimal wobble levels of the low wobble pipet 410 even with ever-increasing force. Accordingly, the low wobble pipet 410 may be inserted at less than 3.0 Lb-force into typical pipet controller 400 and achieve a pipet sag of less than 0.4 inches off nominal, for example.

Additionally, as shown in FIG. 7, the low wobble pipet 410 provides a greater degree of consistency during repetitive uses in the amount of sag or wobble for a given insertion force than a standard pipet 110. As shown in FIG. 7, by the vertical range indicating lines, with standard pipets (e.g., pipet 110), the sag or wobble may vary considerably from pipet controller 400 to pipet controller 400 for the same amount of insertion force.

Figure 8:
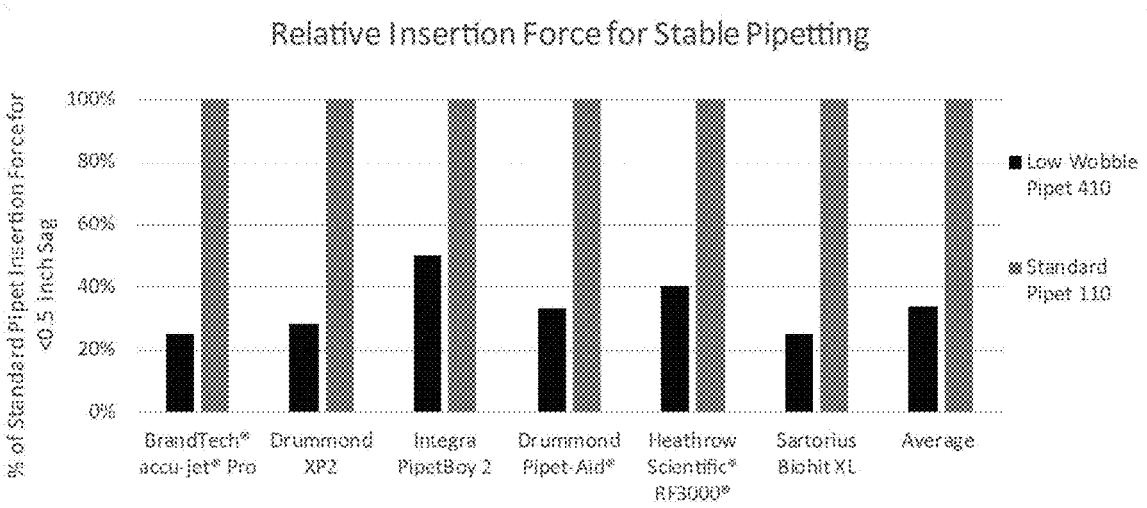
FIG. 8 charts the insertion force required to achieve 0.5 inches or less of sag in six commercially available pipet controllers.

FIG. 8 charts the insertion force required to achieve 0.5 inches or less of sag in six commercially available pipet controllers. In FIG. 8, the insertion force needed to achieve sag or wobble of 0.5 inches or less from horizontal was determined using standard pipet 110 and low wobble pipet 410 with a variety of pipet controllers. The force for the standard pipet 110 using each controller was set at 100% and relative percent force with low wobble pipet 410 determined. With every controller tested, low wobble pipet 410 required a minimum of 50%, less average insertion force to achieve at least 0.5 inches of pipet sag or wobble.

Figure 9A:
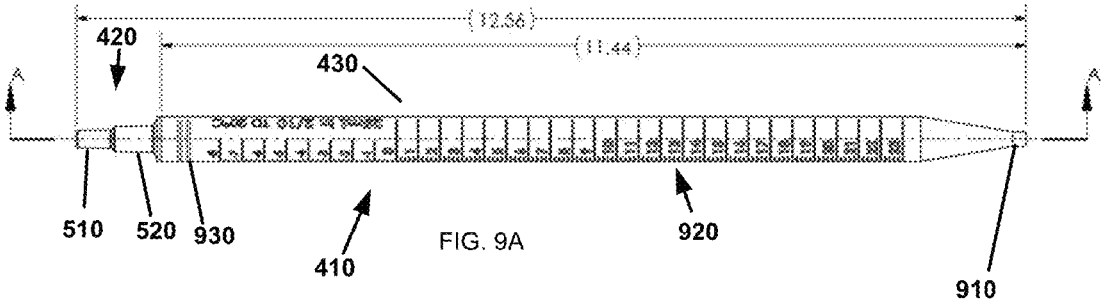
FIG. 9A depicts a low wobble pipet in an embodiment of the invention.

FIG. 9A depicts an embodiment of low wobble pipet 410 for handling liquids. Low wobble pipet includes tip 910, mounting portion 420, tubular shaft 430, graduation lines 920, and color code bands 930. Graduation lines 920 may be perpendicular to pipet body to within 0.007 inches. Color code bands 930 may be 0.04 wide with 0.08 space between the bands and may identify the volume capacity of the pipet 410. In one embodiment, from the top end of the mounting portion 420 to tip 910 may be 12.56 inches with shaft 430 to tip 910 being 11.44 inches. Pipet 430 may also substantially conform to ASTM E934-94 (2015), for example.

Tip 910 and shaft 430 may be made from a plastic resin such as a clear grade polystyrene or other similar material. Mounting portion 420 may be molded out of plastic resin such as transparent gray tinted polystyrene or other similar material. Mounting portion 420 may include at least two sections. The sections may be stepped in that one section's diameter or width may be a different size as another section's diameter or width. The sections may be substantially cylindrical sections. For example, mounting portion 420 may include upper section 510 and lower section 520. Upper section 510 may include a top end with an opening. A distance between two sections (e.g., between upper section 510 and lower section 520) may be dimensioned to inscribe a cone having an angle of 11 degrees plus or minus 5 degrees. Upper section 510 and lower section 520 in mounting portion 420 may measure between 0.12 and 0.36 inches in diameter. Upper section 510 and lower section 520 have different diameters. In particular, an upper section 510 may have a diameter between 0.12 and 0.25 inches and a length between 0.2 and 1.5 inches. Lower section 520 may have a diameter between 0.25 and 0.36 inches and a length of at least 0.12 inches. Additionally, upper section 510 and lower section 520 may have a 0.1 to 5.0 degree taper to accommodate a molding draft angle, for example. Upper section 510 and lower section 520 may be sized to fit two or more sealing rings of a conical seal and designed to reduce side deflection of pipet 410. The upper section may be smaller than the lower section.

Figure 9B:
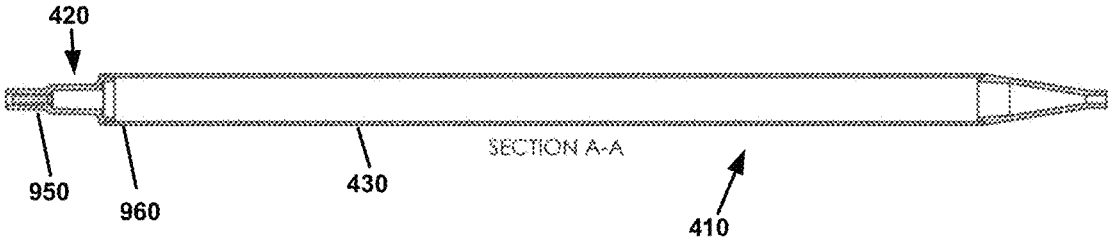
FIG. 9B depicts a cross section of a low wobble pipet in an embodiment of the invention.

FIG. 9B depicts cross section A-A of pipet 410 of FIG. 9A in an embodiment, mounting portion 420 and tip 910 may be welded or otherwise bonded to shaft 430 at opposite ends of shaft 430. Further, mounting portion 420 may be connected to shaft 430 at weld 960. In one embodiment, weld 960 is strong enough such that when the mounting portion 420 is broken off of pipet 410, at least 80% of the time, the break occurs in the mounting portion 420 or the shaft 430 and not at weld 960. Mounting portion 420 may include filter 950. Filter 950 may be a porous filter, such as a filter constructed out of low-density polypropylene or other similar material, and may be 3 mm outer diameter to shoulder.

Figure 10A:
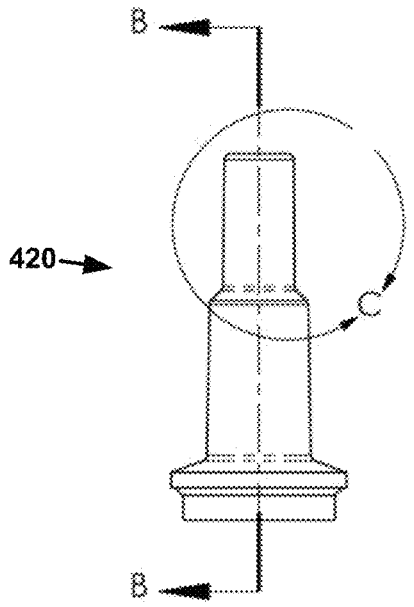
FIGS. 10A-10C illustrate features of a low wobble pipet in an embodiment of the invention.

FIG. 10A illustrates an example mounting portion 420 an embodiment of the invention.

Figure 10B:
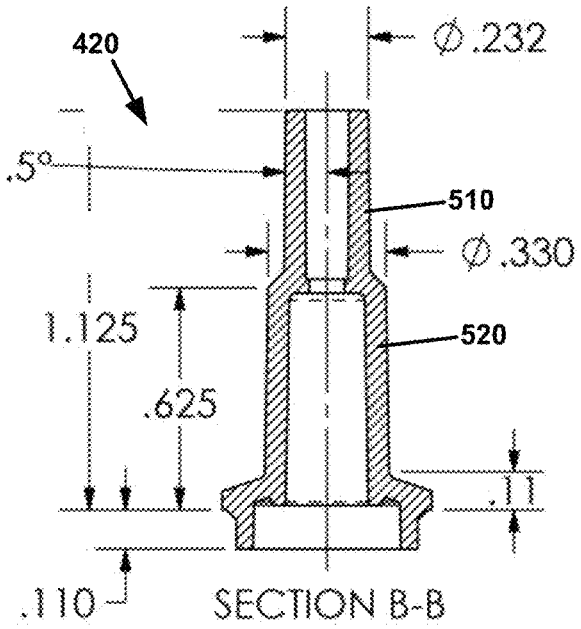

FIG. 10B illustrates a cross-section B-B of the example mounting portion 420 shown in FIG. 10A. In an embodiment shown in FIG. 10B, mounting portion 420 may be 1.125 inches long from shaft 430 to the other end of mounting portion 420. Section 510 of mounting portion 420 may be 0.232 inches wide and section 520 may be 0.33 inches wide and 0.625 inches long.

Figure 10C:
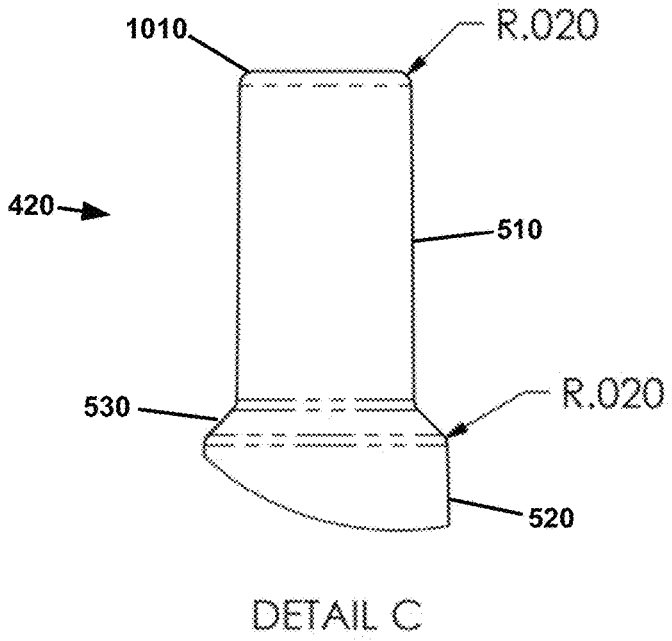

FIG. 10C illustrates further detail of the example mounting portion 420 shown in FIG. 10A. In an embodiment shown in FIG. 10C, section 510 may be separated by section 520 by riser 530 with a rounded edge with a radius of 0.02. The end 1010 of mounting portion 420 opposite from shaft 430 may have a rounded edge with a radius of 0.02.

Figure 11A:
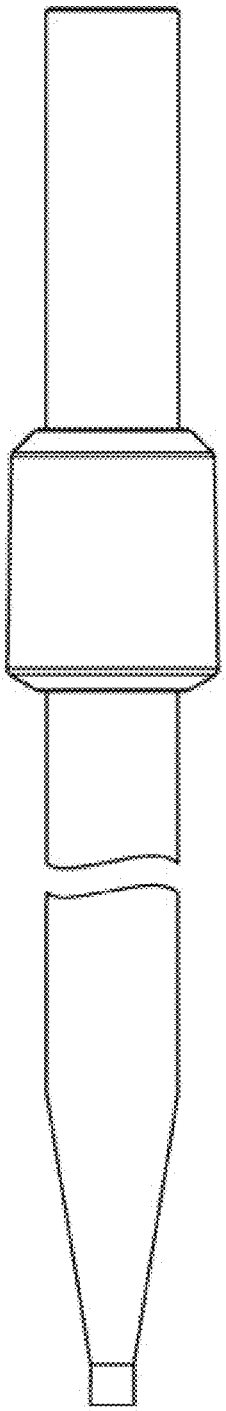
FIGS. 11A-11C depict a 1 ml low wobble pipet in an embodiment of the invention.

FIG. 11A depicts a front view of a 1 ml low wobble pipet in an embodiment of the invention.

Figure 11B:
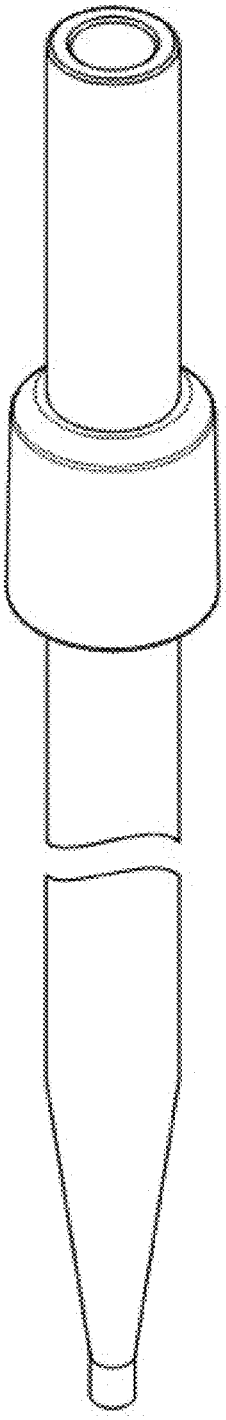

FIG. 11B depicts a front perspective view of a 1 ml low wobble pipet in an embodiment of the invention.

Figure 11C:
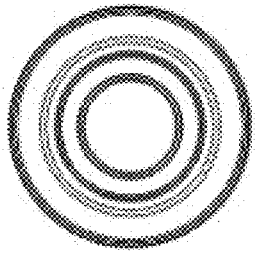

FIG. 11C depicts a top view of a 1 ml low wobble pipet in an embodiment of the invention.

Figure 12A:
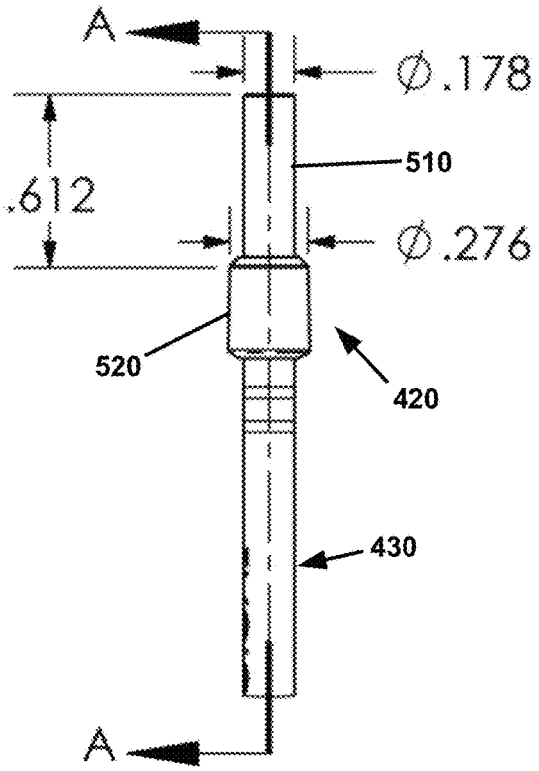
FIGS. 12A-12B depict additional details of a 1 ml low wobble pipet in an embodiment of the invention.

FIG. 12A depicts additional details of the 1 ml low wobble pipet shown in FIGS. 11A-11C in an embodiment of the invention. In FIG. 12A, mounting portion 420 includes section 510 with a diameter of 0.178 inches and a length of 0.612 inches and section 520 with a diameter of 0.276 inches. In this embodiment, lower section 520 may be a separate tubular piece that is bonded to shaft 430, and upper section 510 is formed by the extension of shaft 430.

Figure 12B:
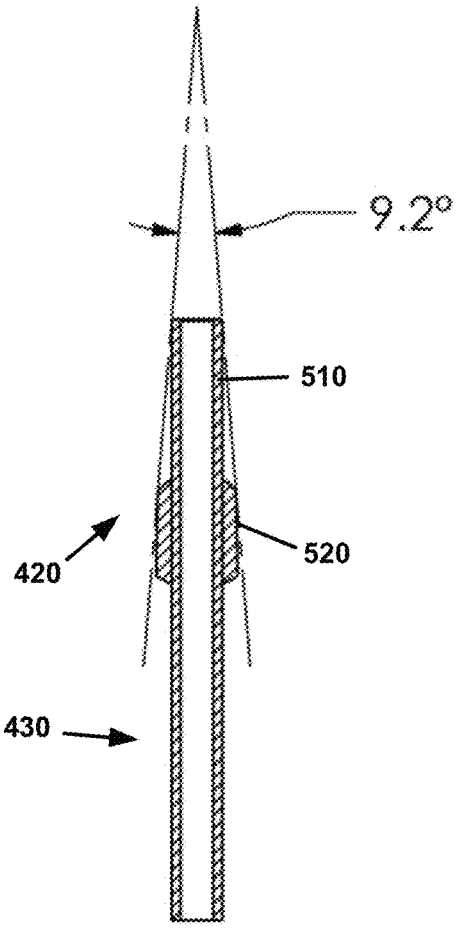

FIG. 12B depicts cross-section A-A of FIG. 12A. FIG. 12B depicts section 510 and section 520 inscribing a conical surface that has a taper angle of 9.2 degrees.

Figure 13A:
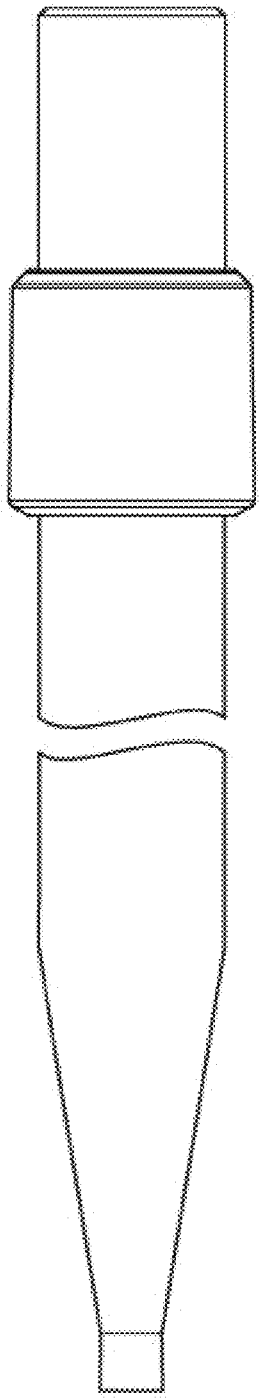
FIGS. 13A-13C depict a 2 ml low wobble pipet in an embodiment of the invention.

FIG. 13A depicts a front view of a 2 ml low wobble pipet in an embodiment of the invention.

Figure 13B:
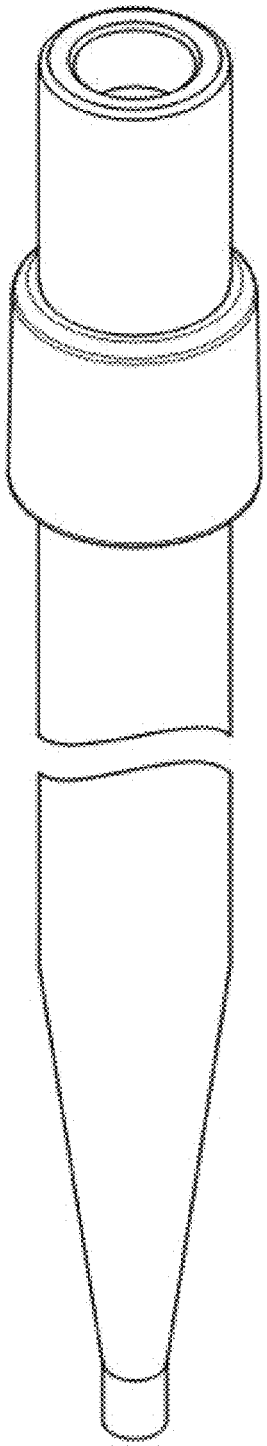

FIG. 13B depicts a front perspective view of a 2 ml low wobble pipet in an embodiment of the invention.

Figure 13C:
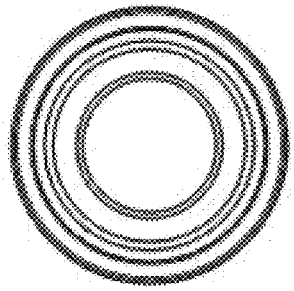

FIG. 13C depicts a top view of a 2 ml low wobble pipet in an embodiment of the invention.

Figure 14A:
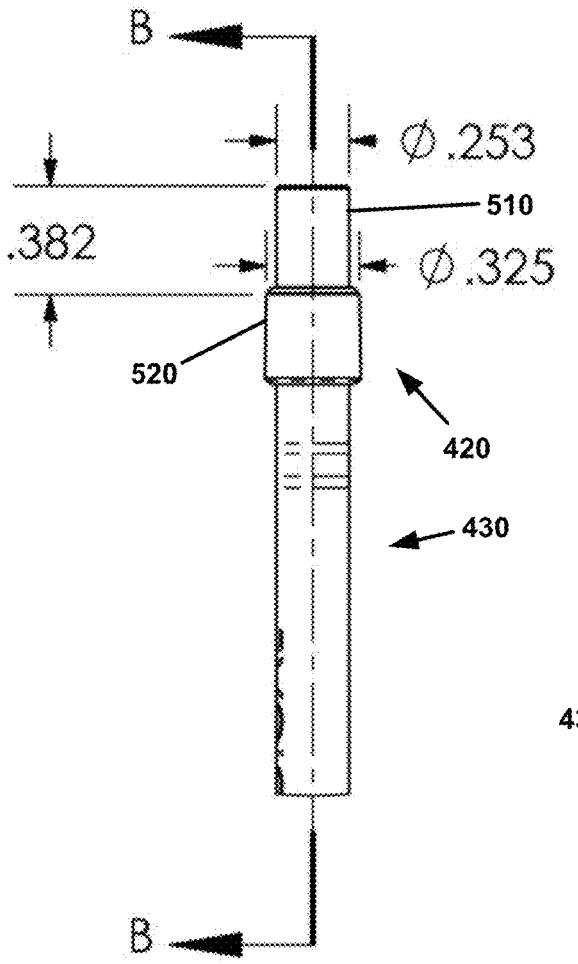
FIGS. 14A-14B depict additional details of a 2 ml low wobble pipet in an embodiment of the invention.

FIG. 14A depicts additional details of the 2 ml low wobble pipet shown in FIGS. 13A-13C in an embodiment of the invention. In FIG. 14A, mounting portion 420 includes section 510 with a diameter of 0.253 inches and a length of 0.382 inches and section 520 with a diameter of 0.325 inches. In this embodiment, lower section 520 may be a separate tubular piece that is bonded to shaft 430, and upper section 510 is formed by the extension of shaft 430.

Figure 14B:
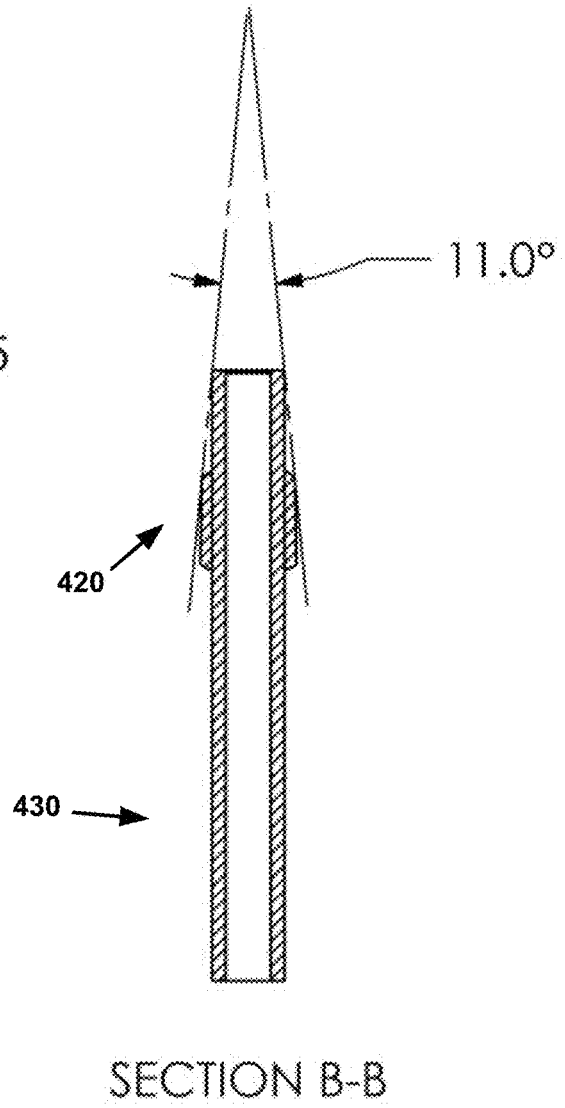

FIG. 14B depicts cross-section B-B of FIG. 14A. FIG. 14B depicts section 510 and section 520 inscribing a conical surface that has a taper angle of 11.0 degrees.

Figure 15A:
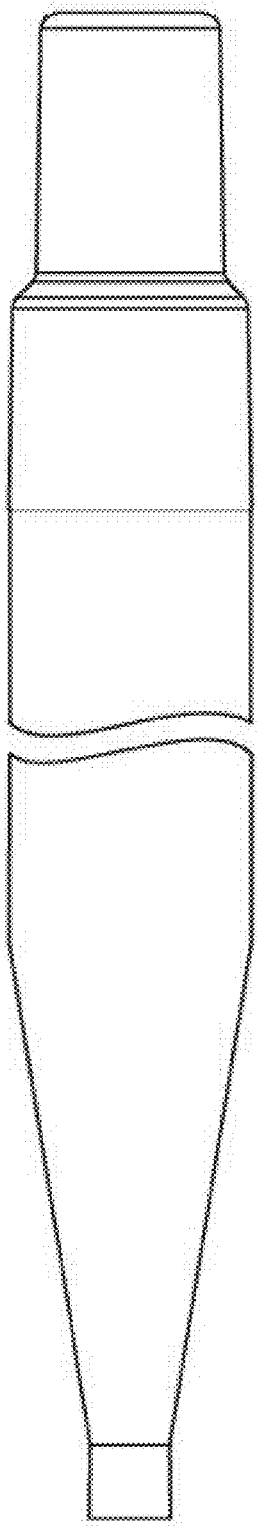

FIG. 15A depicts a front view of a 5 ml low wobble pipet in an embodiment of the invention.

Figure 15B:
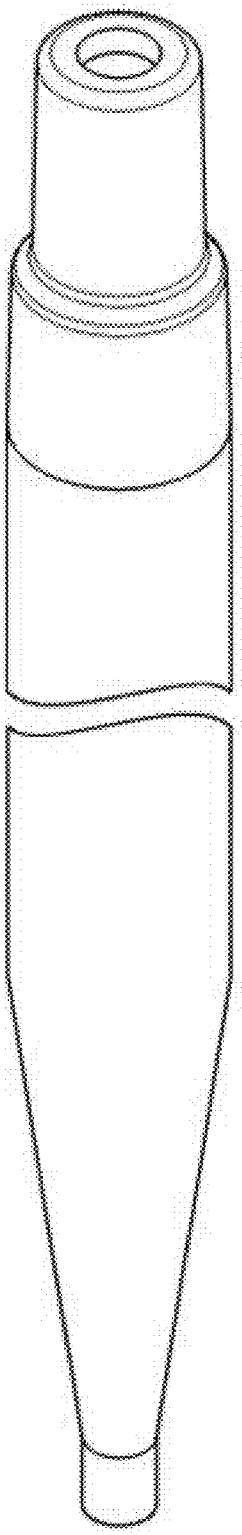

FIG. 15B depicts a front perspective view of a 5 ml low wobble pipet in an embodiment of the invention.

Figure 15C:
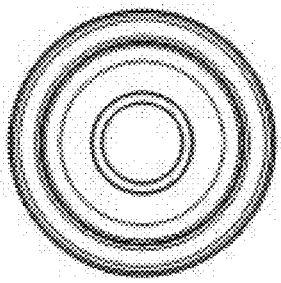

FIG. 15C depicts a top view of a 5 ml low wobble pipet in an embodiment of the invention.

Figure 16A:
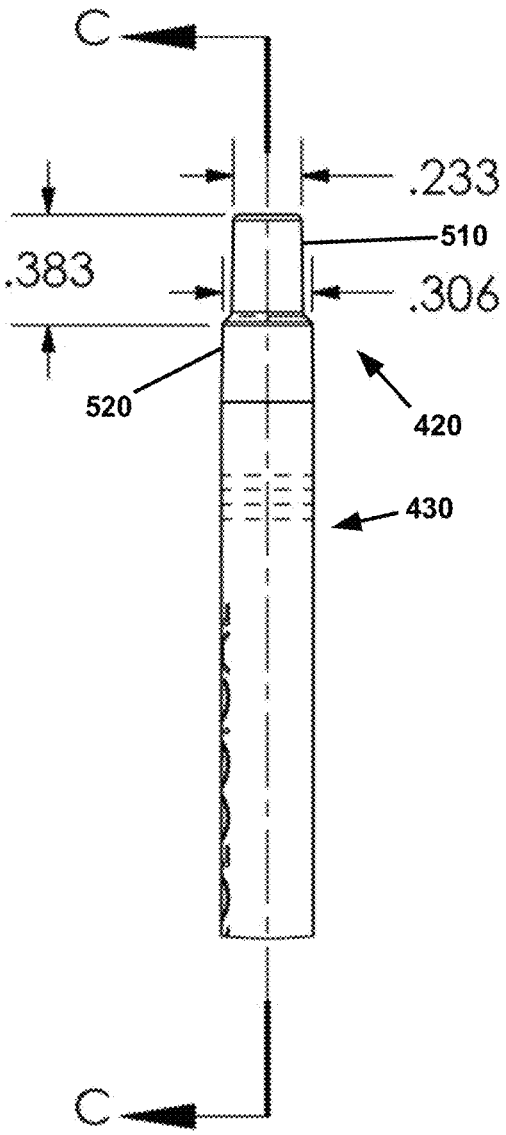
FIGS. 16A-16B depict additional details of a 5 ml low wobble pipet in an embodiment of the invention.

FIG. 16A depicts additional details of the 5 ml low wobble pipet shown in FIGS. 15A-15C in an embodiment of the invention. In FIG. 16A, mounting portion 420 includes section 510 with a diameter of 0.233 inches and a length of 0.383 inches and section 520 with a diameter of 0.306 inches.

Figure 16B:
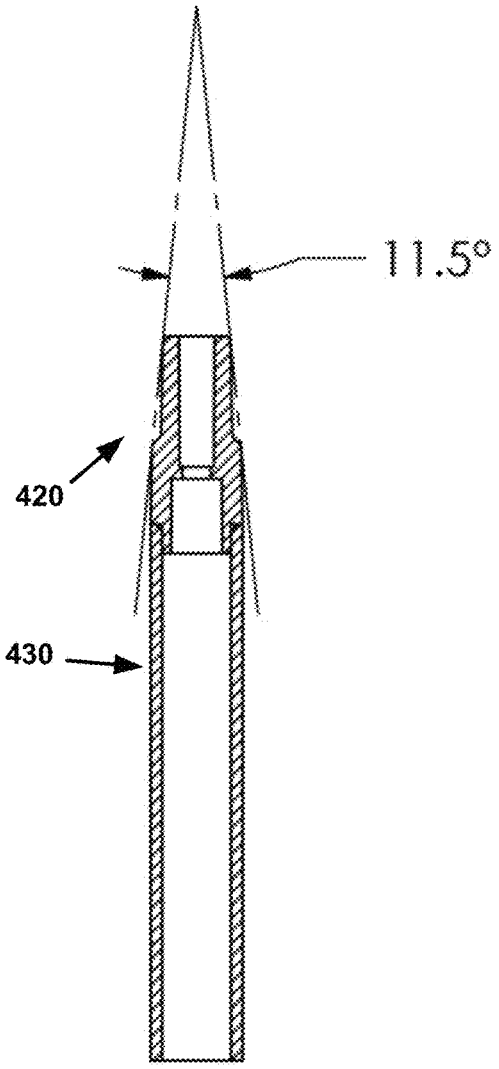

FIG. 16B depicts cross-section C-C of FIG. 16A. FIG. 16B depicts section 510 and section 520 inscribing a conical surface that has a taper angle of 11.5 degrees.

Figure 17A:
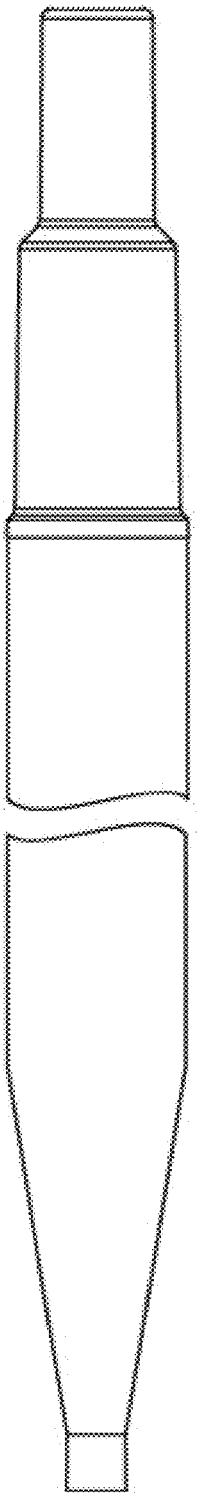
FIGS. 17A-17C depict a 10 ml low wobble pipet in an embodiment of the invention.

FIG. 17A depicts a front view of a 10 ml low wobble pipet in an embodiment of the invention.

Figure 17B:
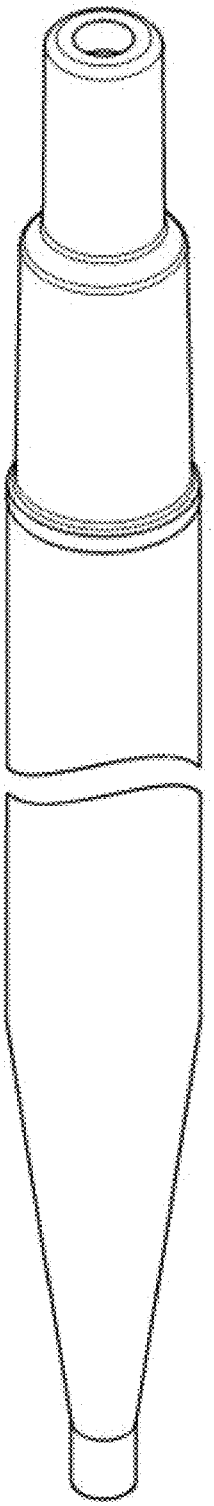

FIG. 17B depicts a front perspective view of a 10 ml low wobble pipet in an embodiment of the invention.

Figure 17C:
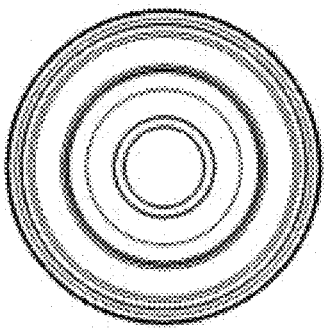

FIG. 17C depicts a top view of a 10 ml low wobble pipet in an embodiment of the invention.

Figure 18A:
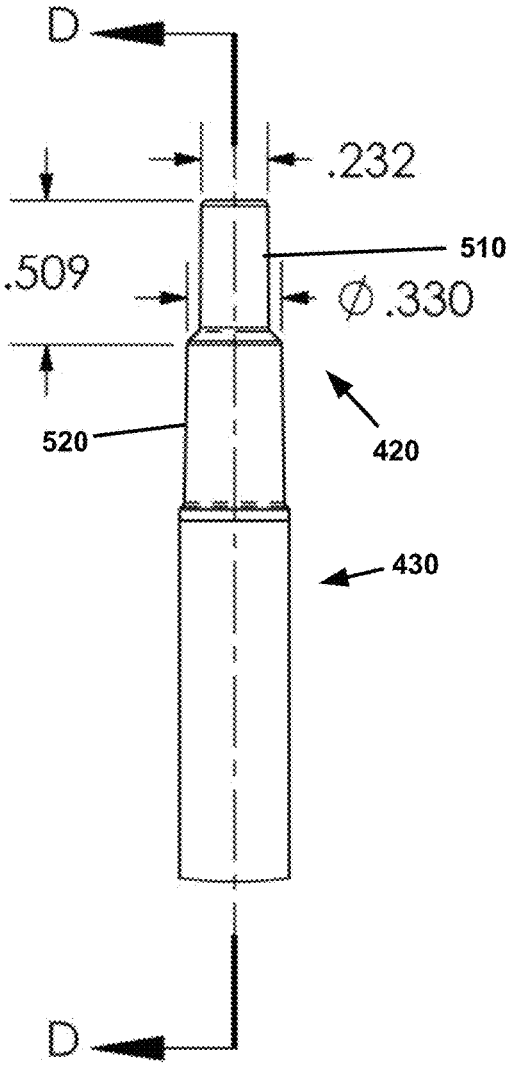
FIGS. 18A-18B depict additional details of a 10 ml low wobble pipet in an embodiment of the invention.

FIG. 18A depicts additional details of the 10 ml low wobble pipet shown in FIGS. 17A-17C in an embodiment of the invention. In FIG. 18A, mounting portion 420 includes section 510 with a diameter of 0.232 inches and a length of 0.509 inches and section 520 with a diameter of 0.330 inches.

Figure 18B:
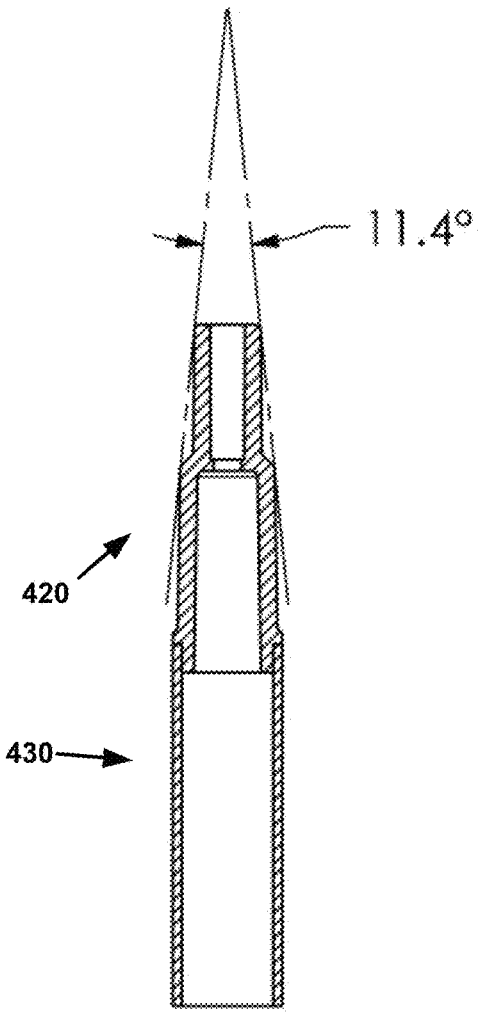

FIG. 18B depicts cross-section D-D of FIG. 18A. FIG. 18B depicts section 510 and section 520 inscribing a conical surface that has a taper angle of 11.4 degrees.

Figure 19A:
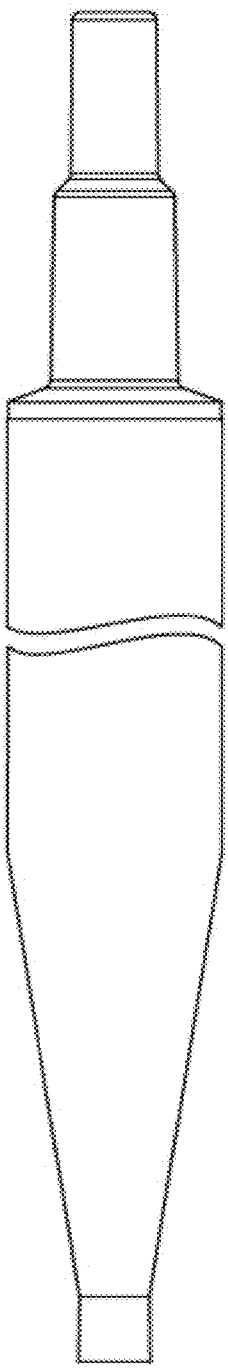
FIGS. 19A-19C depict a 25 ml low wobble pipet in an embodiment of the invention.

FIG. 19A depicts a front view of a 25 ml low wobble pipet in an embodiment of the invention.

Figure 19B:
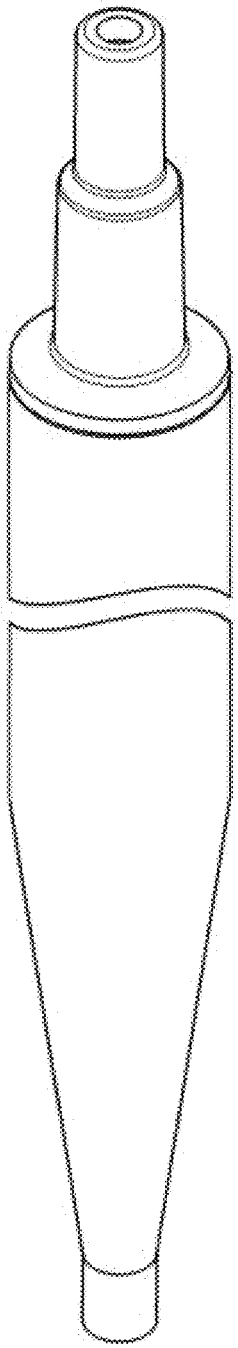

FIG. 19B depicts a front perspective view of a 25 ml low wobble pipet in an embodiment of the invention.

Figure 19C:
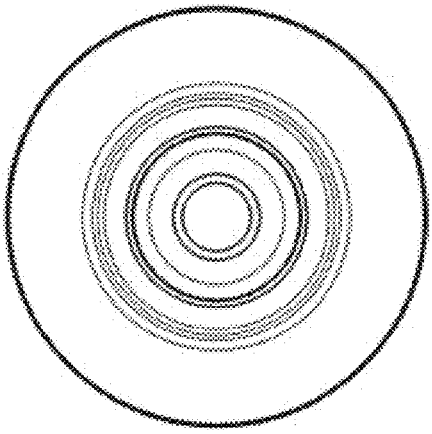

FIG. 19C depicts a top view of a 25 ml low wobble pipet in an embodiment of the invention.

Figure 20A:
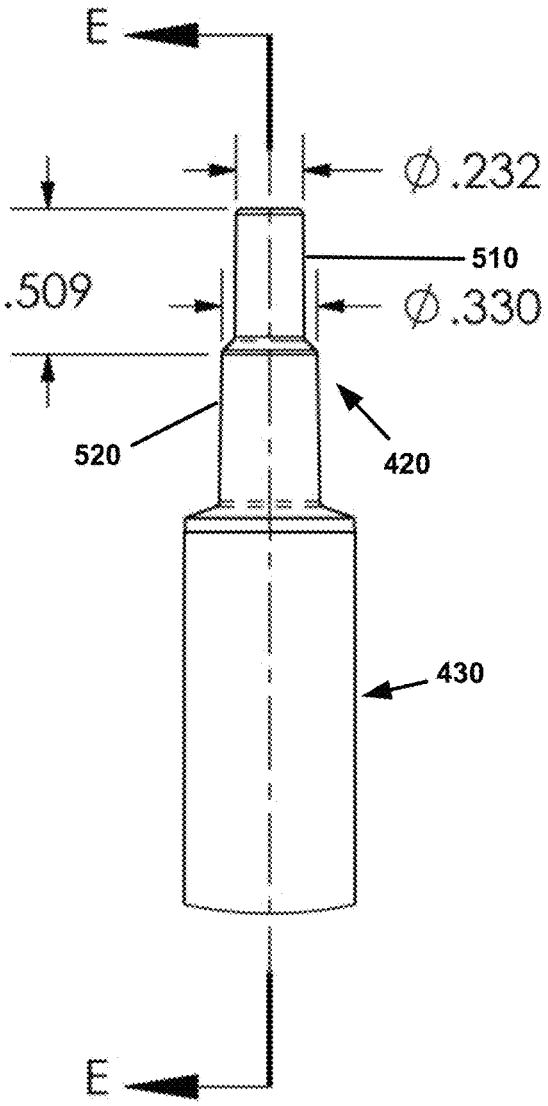
FIGS. 20A-20B depict additional details of a 25 ml low wobble pipet in an embodiment of the invention.

FIG. 20A depicts additional details of the 25 ml low wobble pipet shown in FIGS. 19A-19C in an embodiment of the invention. In FIG. 20A, mounting portion 420 includes section 510 with a diameter of 0.232 inches and a length of 0.509 inches and section 520 with a diameter of 0.330 inches.

Figure 20B:
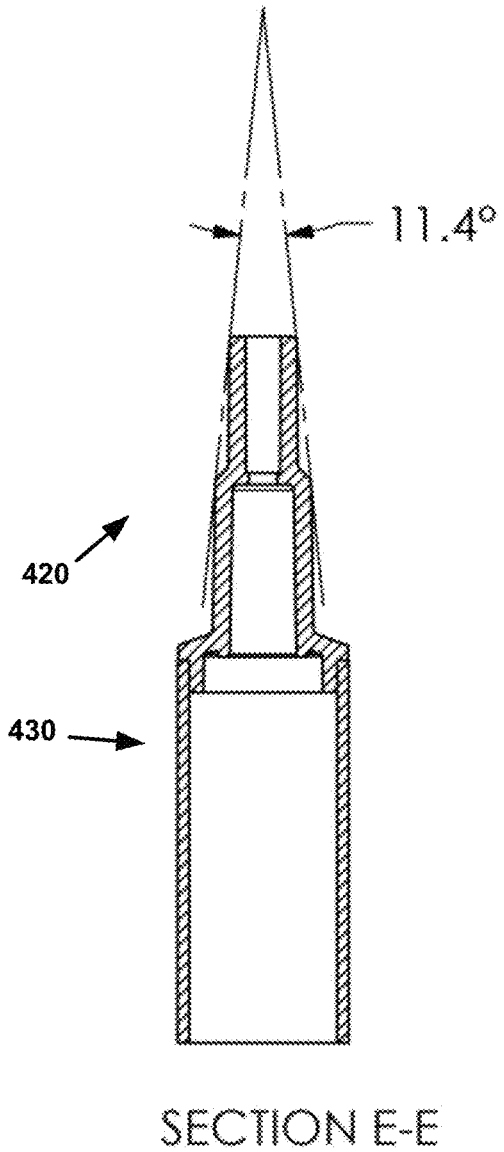

FIG. 20B depicts cross-section D-D of FIG. 20A. FIG. 20B depicts section 510 and section 520 inscribing a conical surface that has a taper angle of 11.4 degrees.

Figure 21A:
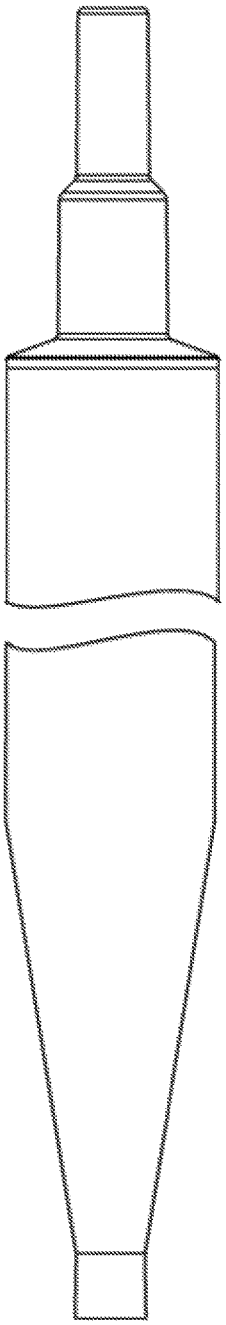
FIGS. 21A-21C depict a 50 ml low wobble pipet in an embodiment of the invention.

FIG. 21A depicts a front view of a 50 ml low wobble pipet in an embodiment of the invention.

Figure 21B:
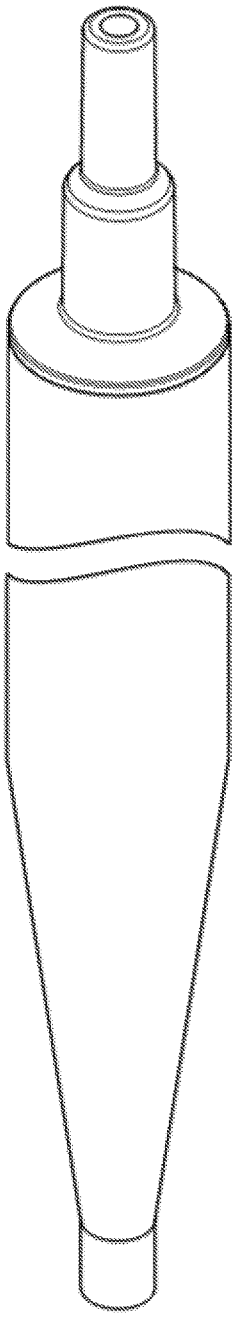

FIG. 21B depicts a front perspective view of a 50 ml low wobble pipet in an embodiment of the invention.

Figure 21C:
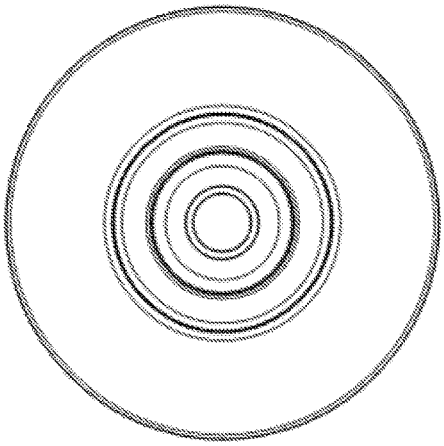

FIG. 21C depicts a top view of a 50 ml low wobble pipet in an embodiment of the invention.

Figure 22A:
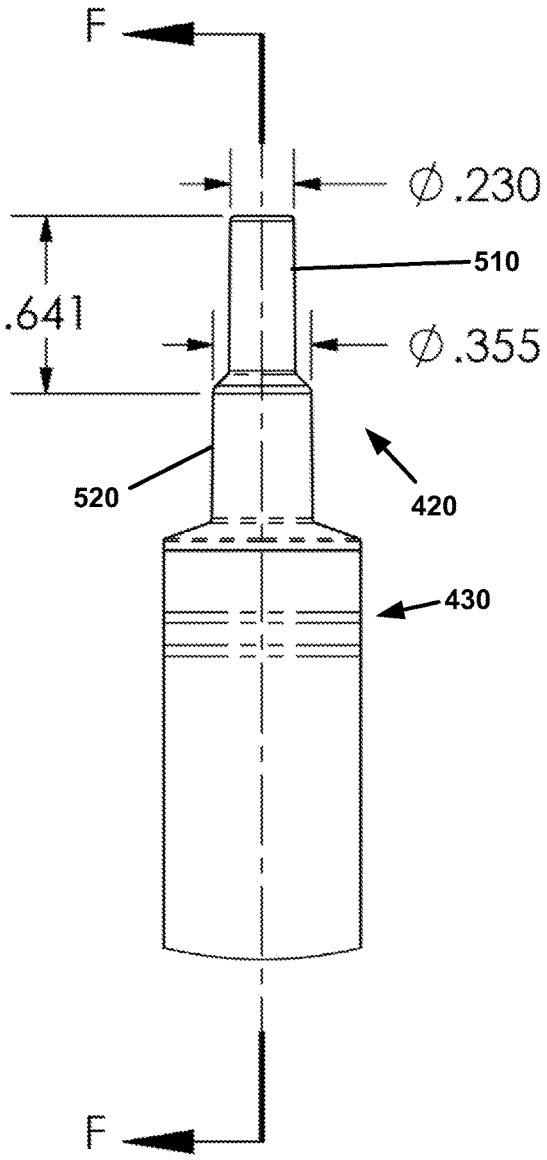
FIGS. 22A-22B depict additional details of a 50 ml low wobble pipet in an embodiment of the invention.

FIG. 22A depicts additional details of the 50 ml low wobble pipet shown in FIGS. 21A-21C in an embodiment of the invention. In FIG. 22A, mounting portion 420 includes section 510 with a diameter of 0.230 inches and a length of 0.641 inches and section 520 with a diameter of 0.355 inches.

Figure 22B:
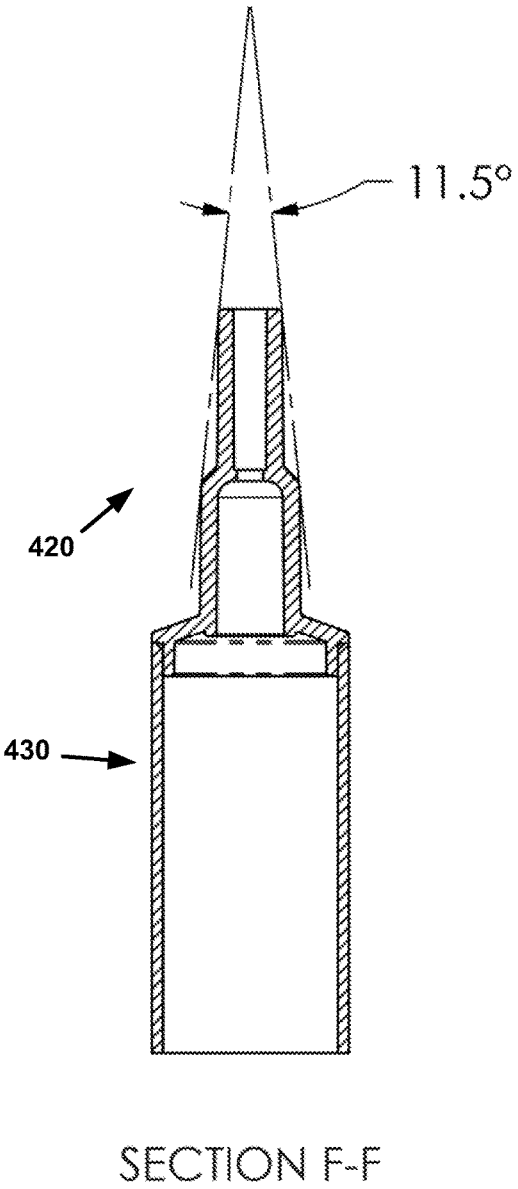

FIG. 22B depicts cross-section D-D of FIG. 22A. FIG. 22B depicts section 510 and section 520 inscribing a conical surface that has a taper angle of 11.5 degrees.

Figure 23A:
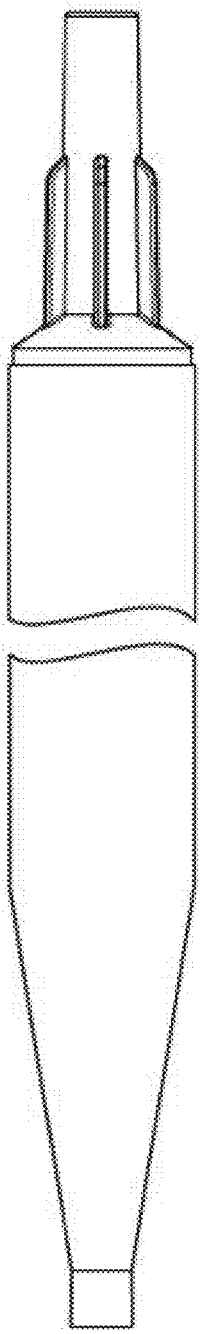
FIGS. 23A-23C depict a ribbed embodiment of a low wobble pipet design in an embodiment of the invention.

FIG. 23A depicts a front view of a ribbed low wobble pipet in an embodiment of the invention.

Figure 23B:
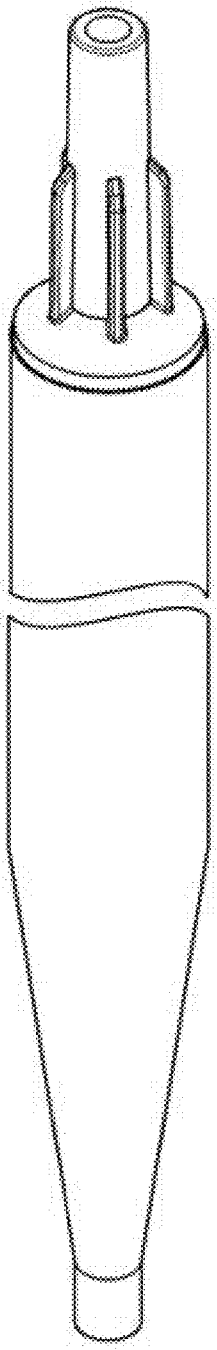

FIG. 23B depicts a front perspective view of a ribbed low wobble pipet in an embodiment of the invention.

Figure 23C:
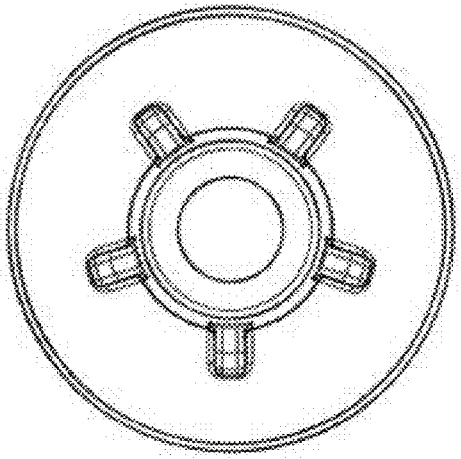

FIG. 23C depicts a top view of a ribbed low wobble pipet in an embodiment of the invention.

In an embodiment such as FIGS. 23A-23C, a pipet may have a mounting portion that includes an upper section and a lower section. The upper section may include a top-end opposite from the tip. The top-end may form an airtight seal with a cone in the pipet holder 100 when the pipet is inserted into the pipet controller 400. The lower section may include a series of at least three radially placed ribs extending longitudinally. The ribs may aid in stabilizing the pipet and preventing wobble. The size of the at least three ribs and a distance between the at least three ribs and the top end may be dimensioned to inscribe a cone having an angle of 6-16 degrees, for example. This configuration could be reversed, whereby the upper section of the mounting portion of the pipette is ribbed and the lower section is substantially cylindrical and is dimensioned to form an airtight seal with the conical seal in the pipet controller.

24A depicts an example ball embodiment of a low wobble pipet in an embodiment of the invention.

Figure 24A:
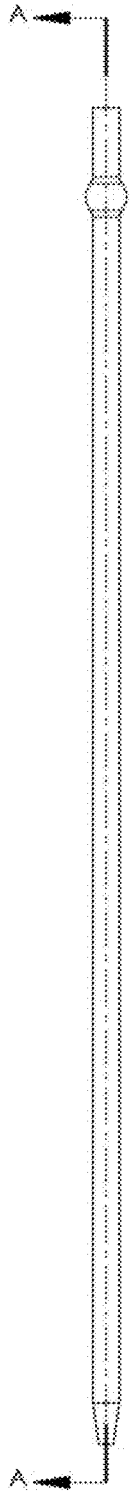
FIGS. 24A-24D depict a ball embodiment of a low wobble pipet design in an embodiment of the invention.
Figure 24B:
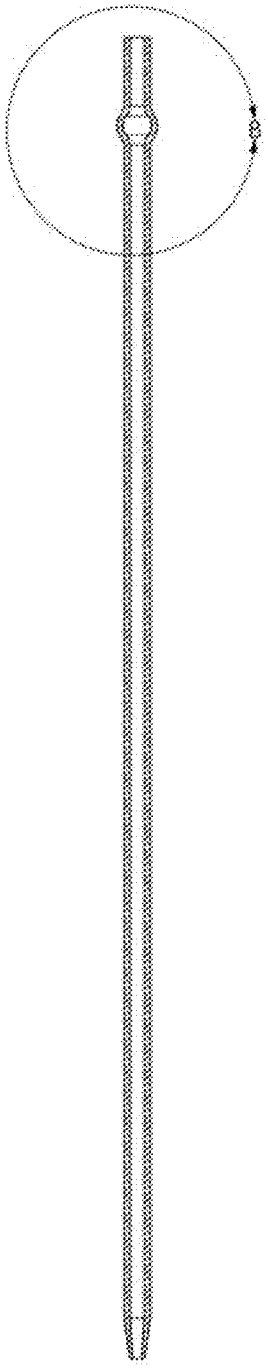

FIG. 24B depicts a cross-section of the ball embodiment of a low wobble pipet of FIG. 24A.

Figure 24C:
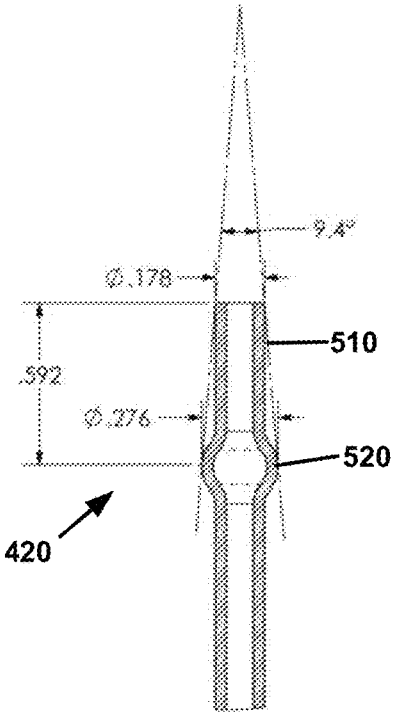

FIG. 24C depicts additional details of the ball embodiment low wobble pipet shown in FIGS. 24A-24B in an embodiment of the invention. In FIG. 24C, mounting portion 420 includes section 510 with a diameter of 0.178 inches and section 520 with a diameter of 0.276 inches. The upper section 510 and lower section 520 inscribe a cone of 9.4 degrees.

Figure 24D:
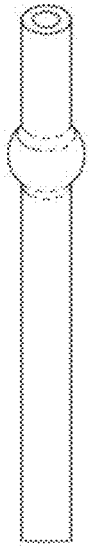

FIG. 24D depict a perspective view of a ball embodiment of a low wobble pipet design in an embodiment of the invention.

Figure 25A:
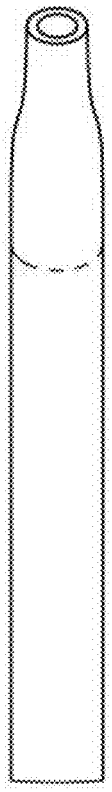
FIGS. 25A-25C depict a tapered embodiment of a low wobble pipet design in an embodiment of the invention.

FIG. 25A depicts a perspective view of a tapered embodiment of a low wobble pipet design in an embodiment of the invention.

Figure 25B:
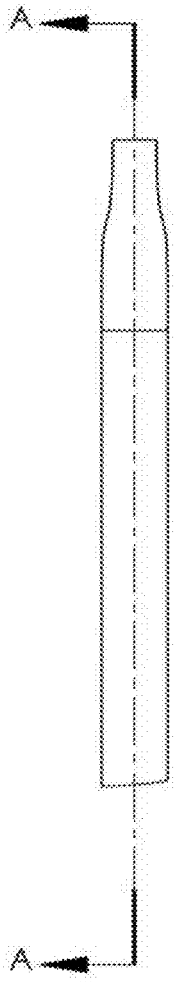

FIG. 25B depicts an example tapered embodiment of a low wobble pipet design in an embodiment of the invention.

Figure 25C:
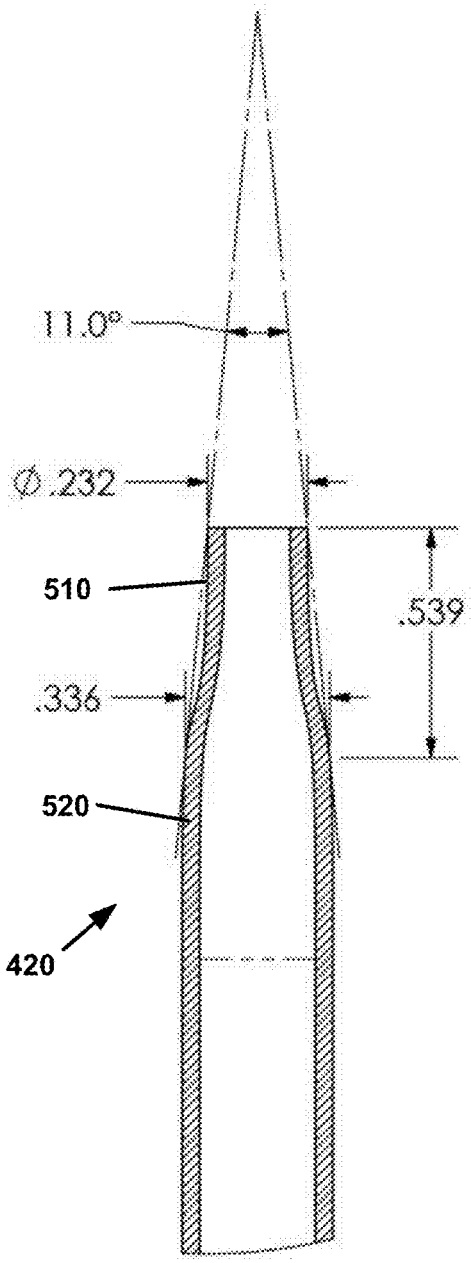

FIG. 25C depicts additional details of the tapered embodiment low wobble pipet shown in FIGS. 25A-25B in an embodiment of the invention. In FIG. 25C, mounting portion 420 includes section 510 with a tapered minimum diameter of 0.232 inches and section 520 with a diameter of 0.336 inches. The upper section 510 and lower section 520 inscribe a cone of 11.0 degrees.

While various embodiments of the present invention have been described above, it should be understood that they have been presented by way of example only, and not limitation. Although the foregoing description is directed to example embodiments of the invention, it is noted that other variations and modifications will be apparent to those skilled in the art, and may be made without departing from the spirit or scope of the invention. Moreover, features described in connection with one embodiment of the invention may be used in conjunction with other embodiments, even if not explicitly stated above.

What is claimed is:

1. A serological pipet for use with liquid handling comprising:

a tip;

a mounting portion comprising at least first and second wall sections with substantially circular cross-sections, wherein the first wall section is farther away from the tip than the second wall section, the first and second wall sections are separated by a step or chamfer and configured to fit into a pipet controller holder, and wherein the mounting portion includes a porous filter; and a tubular shaft with permanently marked volume indicating graduation marks, wherein the tubular shaft connects the tip and the mounting portion, wherein the first and second wall sections have different diameters and are separated by the step or chamfer whereby the first wall section and the second wall section inscribe a cone having an angle of 11 degrees plus or minus 5 degrees, the cone having an apex pointing in a direction opposite the tip.

2. The serological pipet of claim 1, wherein the first and second wall sections are each between 0.12 and 0.36 inches in diameter.

3. The serological pipet of claim 1, wherein the first wall section has a diameter between 0.12 and 0.25 inches.

4. The serological pipet of claim 3, wherein the second wall section has a diameter between 0.25 and 0.36 inches.

5. The serological pipet of claim 1, wherein the first wall section has a length between 0.2 and 1.5 inches.

6. The serological pipet of claim 5, wherein the second wall section has a length of at least 0.12 inches.

7. The serological pipet of claim 1, wherein the first and second wall sections have a 0.1 to 5.0 degree taper to accommodate a molding draft angle.

8. The serological pipet of claim 1, wherein the mounting portion is bonded to the tubular shaft.

9. The serological pipet of claim 1, wherein the tip, the mounting portion, and the tubular shaft are made out of plastic resin.

10. The serological pipet of claim 1, wherein the first wall section and the second wall section are stepped substantially cylindrical sections.

11. A serological pipet for use with liquid handling comprising:

a tip;

a mounting portion configured to fit into a pipet controller holder, the mounting portion comprising first and second wall sections with substantially circular cross-sections, wherein the first wall section is farther away from the tip than the second wall section, the first and second wall sections separated by a step or chamfer, and wherein the first and second wall sections have different diameters and the first and second wall sections are between 0.12 and 0.36 inches in diameter and 0.12 and 1.5 in length;

a tubular shaft connecting the tip and the mounting portion, wherein the tubular shaft has permanent volume indicating graduation marks; and a porous filter inserted into the mounting portion;

wherein the first and second wall sections are separated by the step or chamfer whereby the first and second wall sections inscribe a cone having an angle of 11 degrees plus or minus 5 degrees, the cone having an apex pointing in a direction opposite the tip.

12. The serological pipet of claim 11, wherein the first and second wall sections are sized to fit two or more sealing rings of a conical seal.

13. The serological pipet of claim 11, wherein the first and second wall sections are sized to reduce side deflection of the serological pipet.

14. The serological pipet of claim 11, wherein the serological pipet is configured to be inserted into the pipet controller holder with an insertion force of less than 3.0 Lb-force and achieve an angular deflection of 1° or less.

15. A serological pipet for use with liquid handling comprising:

a tip;

a mounting portion; and a tubular shaft with permanently marked volume indicating graduation marks, the tubular shaft connecting the tip and the mounting portion, wherein the mounting portion further comprises:

a first wall section with a diameter between 0.12 inches and 0.25 inches and a length between 0.20 to 1.5 inches, a second wall section with a diameter between 0.25 and 0.36 inches and a length of at least 0.12 inches, wherein the first wall section is farther away from the tip than the second wall section, the first wall section and the second wall section have different diameters and are separated by a step or chamfer, and both the first wall section and the second wall section are configured to simultaneously fit into a ribbed and tapered elastic socket, and a porous filter;

wherein the first wall section and the second wall section are separated by the step or chamfer whereby the first and second wall sections inscribe a cone having an angle of 11 degrees plus or minus 5 degrees, the cone having an apex pointing in a direction opposite the tip.

16. The serological pipet of claim 15, wherein the mounting portion simultaneously engages the elastic socket at two or more ribbed locations when inserted into the elastic socket.

17. The serological pipet of claim 15, wherein the first wall section and the second wall section have substantially circular cross-sections.

18. A serological pipet for use with liquid handling comprising:

a tip;

a mounting portion with a porous filter; and a tubular shaft with permanently marked volume indicating graduation marks, the tubular shaft connecting the tip and the mounting portion, the mounting portion further comprises:

a first wall section with substantially circular cross-section, and a second section with substantially circular cross-section with at least three ribs placed radially and extending longitudinally, wherein a radial height of the at least three ribs and a distance between the at least three ribs and the first wall section is dimensioned so the first wall section and the at least three ribs inscribe a cone having an angle of 11 plus or minus 5 degrees, the cone having an apex pointing in a direction opposite the tip, and the first wall section and the second section are configured to simultaneously fit into a pipet holder.

19. The serological pipet of claim 18, wherein the first wall section or the second section comprises a top end opposite from the tip.

20. The serological pipet of claim 9, wherein the plastic resin is polystyrene.

21. The serological pipet of claim 11, wherein the tip, the mounting portion, and the tubular shaft are made out of plastic resin.

22. The serological pipet of claim 15, wherein the tip, the mounting portion, and the tubular shaft are made out of plastic resin.

23. The serological pipet of claim 18, wherein the tip, the mounting portion, and the tubular shaft are made out of plastic resin.

* * * * *